US007784635B2

(12) United States Patent
Luburic

(10) Patent No.: US 7,784,635 B2
(45) Date of Patent: Aug. 31, 2010

(54) CONTAINER AND LID WITH MULTIPLE CHAMBERS

(75) Inventor: Frano Luburic, Anaheim Hills, CA (US)

(73) Assignee: Ropak Corporation, Fountain Valley, CA (US)

( * ) Notice: Subject to any disclaimer, the term of this patent is extended or adjusted under 35 U.S.C. 154(b) by 1060 days.

(21) Appl. No.: 10/962,092

(22) Filed: Oct. 7, 2004

(65) Prior Publication Data

US 2006/0076260 A1 Apr. 13, 2006

(51) Int. Cl.
*B65D 1/24* (2006.01)
*B65D 25/04* (2006.01)
*B65D 85/00* (2006.01)

(52) U.S. Cl. ..... 220/505; 220/525; 220/526

(58) Field of Classification Search ..... 220/500, 220/505, 518, 523–526, 555, 557, 711, 756, 220/254.3; D7/513
See application file for complete search history.

(56) References Cited

U.S. PATENT DOCUMENTS 3,064,668 A 11/1962 Alkire et al.
3,081,010 A 3/1963 Tupper
4,340,138 A 7/1982 Bernhardt
4,360,105 A 11/1982 Williams
D273,765 S * 5/1984 Cillario ..... D9/761
4,693,399 A 9/1987 Hickman et al.
4,796,774 A * 1/1989 Nabinger ..... 220/711
5,211,289 A 5/1993 Matthews
5,330,082 A 7/1994 Forsyth
5,421,459 A * 6/1995 Mazzotti ..... 206/549
5,626,251 A * 5/1997 Luburic et al. ..... 220/276
5,671,503 A 9/1997 Uebelacker et al.
5,738,241 A * 4/1998 McEntee ..... 220/532
5,881,904 A * 3/1999 House ..... 220/524
D409,442 S * 5/1999 Kilpatrick et al. ..... D7/513
6,050,442 A 4/2000 Wysocki
6,068,161 A 5/2000 Soehnlen et al.
6,079,586 A * 6/2000 Hanneman ..... 220/526
6,092,647 A 7/2000 Yeh et al.
6,098,805 A * 8/2000 Kent ..... 206/518

(Continued)

OTHER PUBLICATIONS http://www.drugstore.com/products/prod.asp?pid=79853&catid=9619&brand=28092&trx=PLST-0-BRAND&trxp1=9619&trxp2=79853&trxp3=1&trxp4=0&btrx=BUY-PLST-0-BRAND, printed from the Internet Aug. 13, 2004.

*Primary Examiner*—Harry A Grosso
(74) *Attorney, Agent, or Firm*—McKenna Long & Aldridge LLP

(57) ABSTRACT

Apparatus and methods are disclosed for improved containers and lids, and combinations thereof. Multiple compartments are provided in a container, one of which can be formed as the container's handle. The lid incorporates a plurality of hinged openings situated on the periphery of the cover, and the container includes a molded unitary body plastic container comprised of at least two chambers or compartments. The lid openings can be located strategically over or adjacent the container chambers/compartments, to provide independent access thereto. The compartments or chambers within the container separate the contents thereof, while multiple hinged openings may allow access to individual or multiple chambers or compartments within the container. Tamper evidencing structures in conjunction with detents or engagement structures may hold the lid and container openings in the desired relationship during shipping, handling, storage, and/or use. Related methods are disclosed.

25 Claims, 28 Drawing Sheets

U.S. PATENT DOCUMENTS 6,105,813 A * 8/2000 Abbey ..... 220/570
6,301,961 B1 10/2001 Rolfes et al.
6,412,637 B1 * 7/2002 Saunders et al. ..... 206/541
6,467,647 B1 * 10/2002 Tucker et al. ..... 220/793
6,523,713 B1 2/2003 Helms
2002/0148846 A1 * 10/2002 Luburic ..... 220/792

* cited by examiner

CONTAINER AND LID WITH MULTIPLE CHAMBERS

This invention relates to containers and associated lids, and more particularly to containers comprised of multiple chambers or compartments, one of which is in the handle, and a lid that can seal the chambers from each other and/or provide independent access to those chambers.

BACKGROUND OF THE INVENTION

The invention is directed to a new apparatus and design and/or configuration, and related methods for holding, transporting, storing, stacking, and using various things. Containers such as plastic injection-molded buckets, pails, or the like come in a wide variety of shapes and sizes. In many applications and methods, the container and/or bucket/pail can be used with a cover or other sealing device to help contain material within the container. Commonly these containers have covers or lids that, along with other aspects of the container/lid combinations, allow the containers to be nested or stacked, such as on a pallet.

Most such containers provide a single main storage compartment. Some plastic bottles (such as for milk, juice, or the like) have "flow-through" handles, which allow the fluid to be stored and flow within the handle (but not to be "segregated" there within the handle, away from the thing (the liquid) stored in the main storage area of the bottle/container).

Certain containers exist with separate "compartments" sealed from each other. Examples include TV dinners or their equivalent, tool or parts containers with separate "pockets" in which different screws or bolts or tools are stored, etc. These typically have one or more shortcomings that limit their usefulness. For example, and among other things, many such containers do not have a handle that functions as a storage compartment, and do not have the ability to provide a seal over or between the various compartments, or permit separate/discrete access through the lid to the various compartments, providing some resealability after the container has initially been opened. Although plastic bottles exist with two separate compartments sealed by a single screw-on lid, those containers are limited in their use, handling, and other functions (for example, the relatively small neck and screw-on lid limit the size and nature of things that might be conveniently packaged within the container).

OBJECTS AND ADVANTAGES OF THE INVENTION

Accordingly, it is an object of this invention to provide an improved container, lid, and combination of the two. Broadly, the present invention preferably is directed to a container having multiple storage compartments, such as a main storage body/portion and a hollow handle portion. The compartments preferably can be used to store/transport things distinct from each other, but perhaps related to each other. Preferably, a single lid covers both or all compartments, and can provide separate access to each. In alternative embodiments, separate lids can be provided to cover each compartment, and/or no "independent" access may be provided. In alternative embodiments, the compartments may be in communication with each other and thus simply provide additional storage for the same substance in both portions. The containers preferably are nestable with other like containers, and preferably one or more of the compartments comprises or is formed within a handle that can be used to manipulate the container.

In a preferred embodiment, the lid (1) includes tamper-evidencing features, (2) covers both the main storage body and the hollow handle, and (3) provides separate access (via hinge, removable portion, spout, or otherwise) to each of those areas. Among other things, the present invention provides a cover having a built in pour feature (to permit pouring from a first or main container chamber) and a separate access mechanism to one or more further storage chambers such as the preferred handle storage space, and that facilitates stacking of substantially similar containers.

It is another object of this invention to provide a lid and container wherein the lid is configured to cover the container opening or openings. The lid preferably is characterized by two or more openings located on the periphery of said lid, and the container is characterized by two or more chambers or compartments.

A further object of the invention is the provisions of a lid for a container, with the lid having a central section to cover an opening in the container. The central section has an edge portion to contact a rim of the container, and has a center portion that includes a downwardly oriented seal structure to sealingly engage a corresponding internal structure on a container (such as an internal structure separating two or more chambers of the container from each other).

Yet another object of this invention is the provision of a defined chamber or storage compartment in the handle structure of a container. In certain embodiments, at least one opening in a mating lid corresponds to the chamber in the container handle, to permit independent access to the contents of the handle storage area. Creating one or more separate chambers or compartments in the container handle provides great flexibility for use of the container, such as facilitating the storage, packing, or inclusion of an object, material, or substance which is different from the object, material, or substance placed in the other chambers or compartments of the container.

Still another object of the invention is the provision of a container formed as a unitary body comprised of at least two substantially segregated chambers, in which said container is nestable with like containers. Among other things, such nestability can greatly improve the economics of storing the containers when they are empty (such as prior to them being used).

An additional object of the invention is the provision of a container formed as a unitary body comprised of at least two substantially segregated chambers, in which one chamber is substantially encompassed within a handle portion of said container. Among other things, using the handle for storage improves the space efficiency and economics of the container during all phases of its manufacture and use.

A further object of the invention is to provide a lid and container combination of the foregoing character, which further include a detent or otherwise contoured space between the hinged openings of the lid, which space corresponds to a detent or contoured bottom of the container. Such corresponding structures allow the containers to be stacked or nested during shipping, storing, or for packaging.

Another object of the invention is to provide a lid and container combination of the foregoing character, which further insures the integrity of the final contents of the container via the provision of tamper-evidencing structures such as one or more tearstrips. The tamper-evidencing structures such as a tearstrip or strips can be of any suitable configuration and material, including alternatives that may have an integral or other ring-like structure for disengaging the tearstrip(s) from the lid/container assembly, as well as the potential use of primary and secondary detent or engagement structures acting between the lid and container. In certain embodiments, these structures can be strategically positioned on the lid and/or assembly, such as to facilitate the non-hinged portion of the lid remaining engaged with the container when the tearstrip(s) have been removed, and to secure the hinged openings back in a closed position (engaged with the container opening) when desired.

A further object of the invention is the provision of a container and lid combination of the foregoing character, in which at least one of the chambers forms a handle for manipulating the container, and the container further includes an upper engaging edge between the handle chamber and the remainder of the container. The upper engaging edge can be configured to sealingly engage with a corresponding seal structure on the lid, to thereby seal the handle chamber from communication with the remainder of the container.

Other objects and advantages of the invention will be apparent from the following specification and the accompanying drawings, which are for the purpose of illustration only.

DESCRIPTION OF PREFERRED EMBODIMENT

Figure 1:
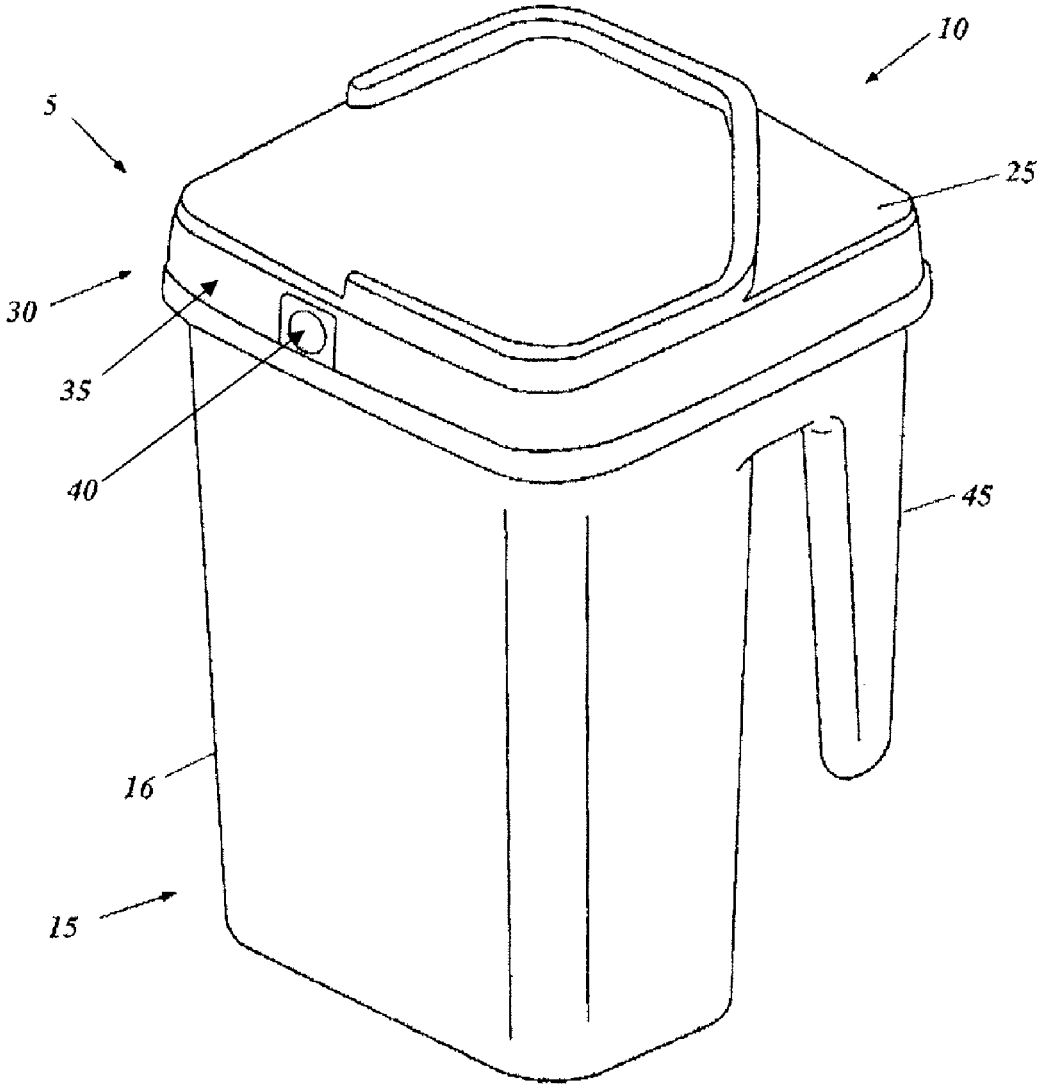
FIG. 1 is a perspective view of one preferred embodiment of the present invention, including a raised cover portion, a built-in pour feature over a main container compartment, a hinged cover portion over a handle compartment, and a tamper evident tear strip.

Broadly, the present invention is directed to a container and lid which provide separate compartments within a single container to facilitate, for example, transportation, storage, handling, etc. of products that may be related to each other.

The various components of the invention can be fabricated in any suitable manner and from any suitable material. Preferably, to provide the container and lid in a relatively inexpensive economic and useful manner and form having desirable sealing discussed herein, the container and lid can be injection molded or otherwise formed from one or more suitable materials. By way of example and not by way of limitation, these could include plastic, vinyl, or similar material, metal, injection or blow-molded materials, and others.

As explained further below, FIGS. 1-5 illustrate one of the many embodiments of the invention, one having a main storage body/portion and a preferably hollow handle portion. The hollow handle can be used to store/transport something distinct from the contents of the main storage body/portion (such as a promotional item, a liquid or granular or other substance that is complementary to the substance in the main storage body/portion, etc.), or may alternatively be in communication with the main storage body/portion and thus simply provide additional storage for the same substance as is in that main storage body/portion. Depending on the size, shape, and nature of the things stored in the multiple compartments, segregation can be maintained between them via a seal between the compartments or simply a sufficiently close spacing between the lid and the container at the location of the wall or walls dividing the compartments or chambers from each other.

In the embodiment of FIGS. 1-5, the lid preferably (1) includes tamper-evidencing features, (2) covers both the main storage body and the hollow handle, and (3) provides separate hinged access to each of those areas (the main body and the handle). Among other things, this embodiment of the present invention preferably provides a built in pour feature (to permit pouring or other access to and from the main chamber 16), a separate hinged cover area to access the preferred handle storage space, and a cover that facilitates stacking of substantially similar containers.

As illustrated in FIGS. 1-5, the preferred container assembly 5 of the invention includes a cover or lid 10 and container 15. The cover 10 preferably includes a pour feature 20 and hinged handle cover portion 25. The access to each chamber or compartment in the container can be of any suitable type. In some of the embodiments described herein, the access is resealable, at least over the handle cover portion 25. Certain embodiments can include a plurality of such access structures, including at least one hinged opening on each side of a seal structure formed in the lid, as described herein.

Figure 2:
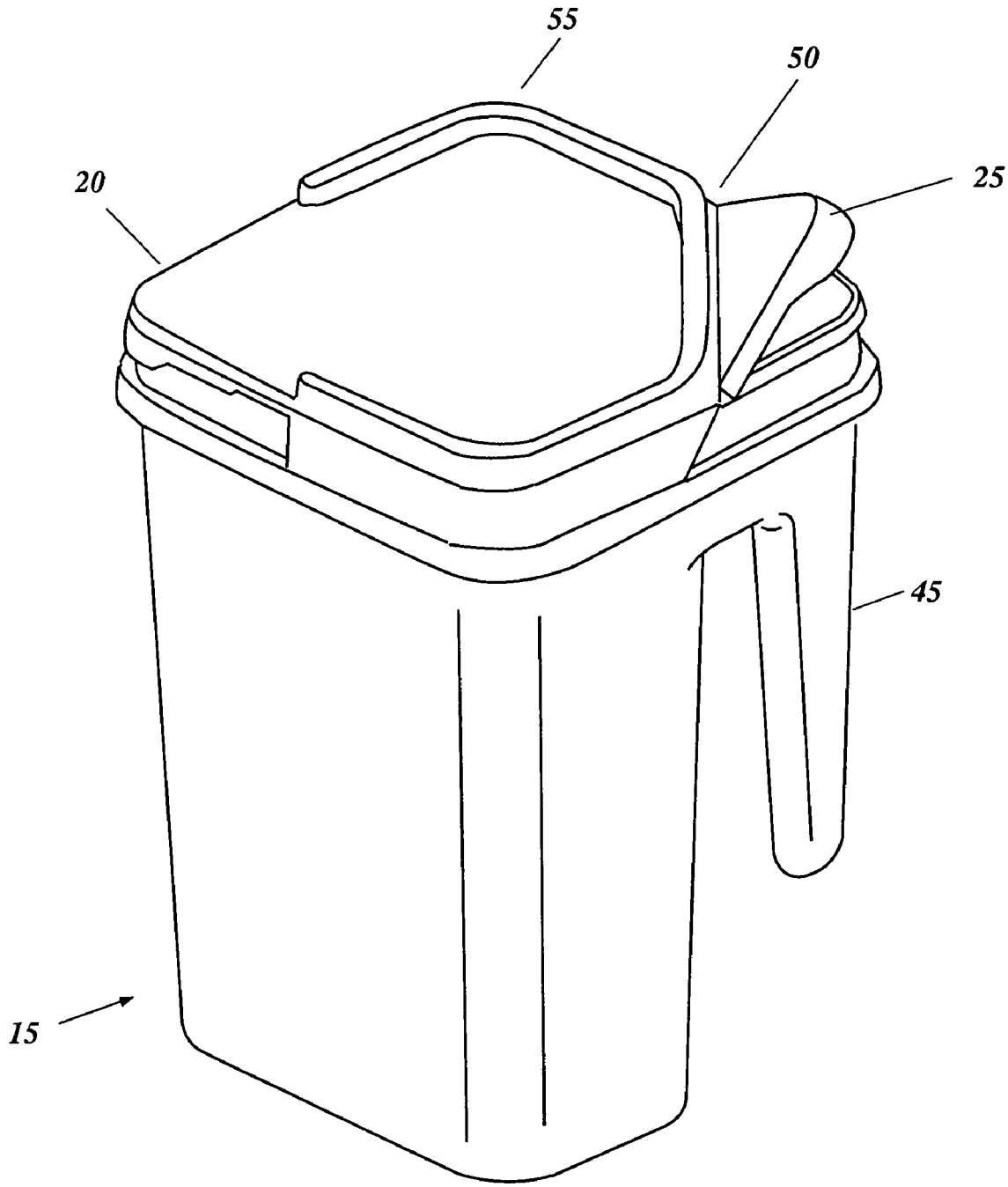
FIG. 2 is a perspective view similar to FIG. 1, and shows the hinged cover portion over the handle in an open position, and the tear strip removed.
Figure 3:
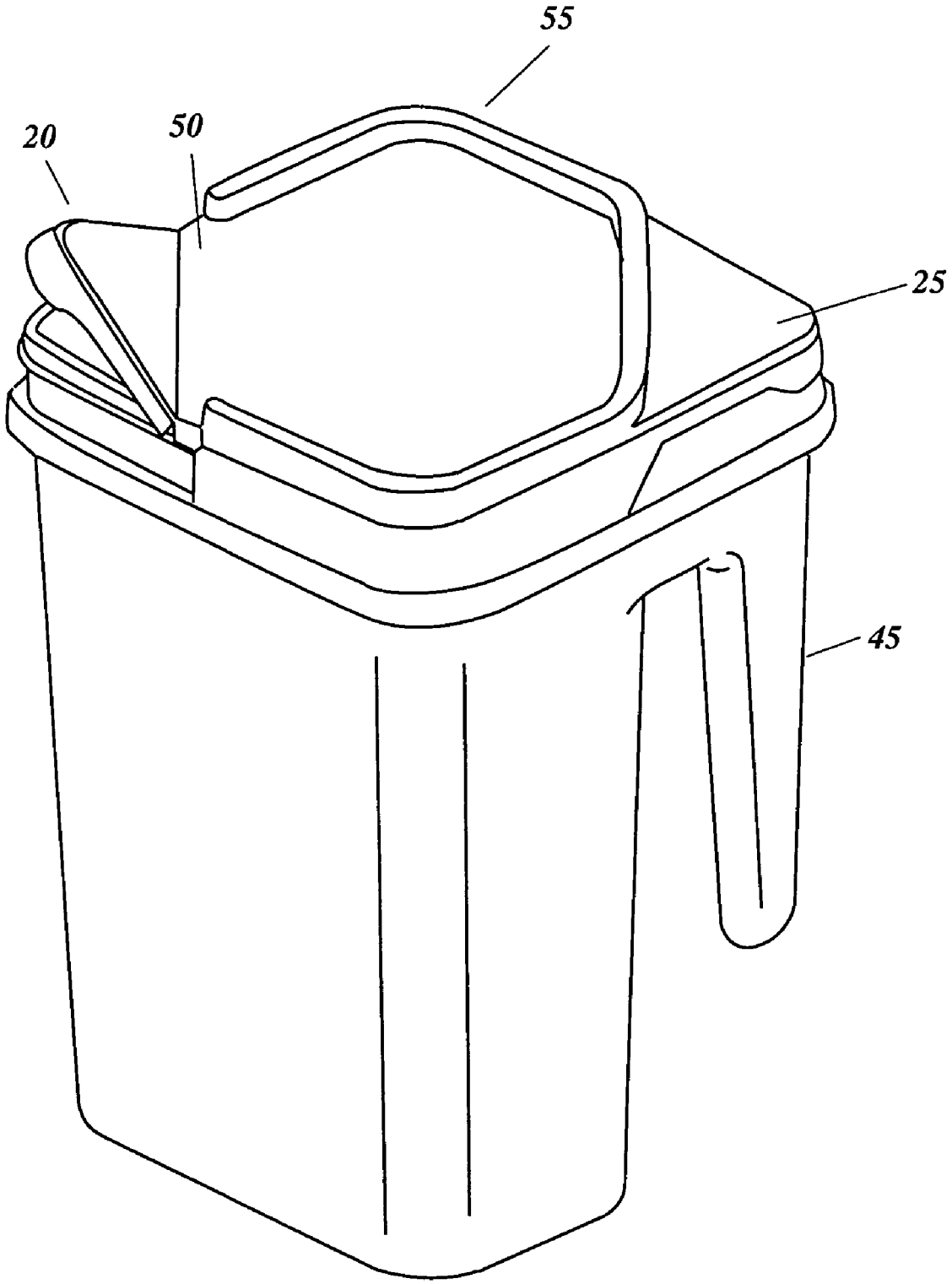
FIG. 3 is a perspective view similar to FIG. 2, and shows the built-in pour feature in an open position.
Figure 15:
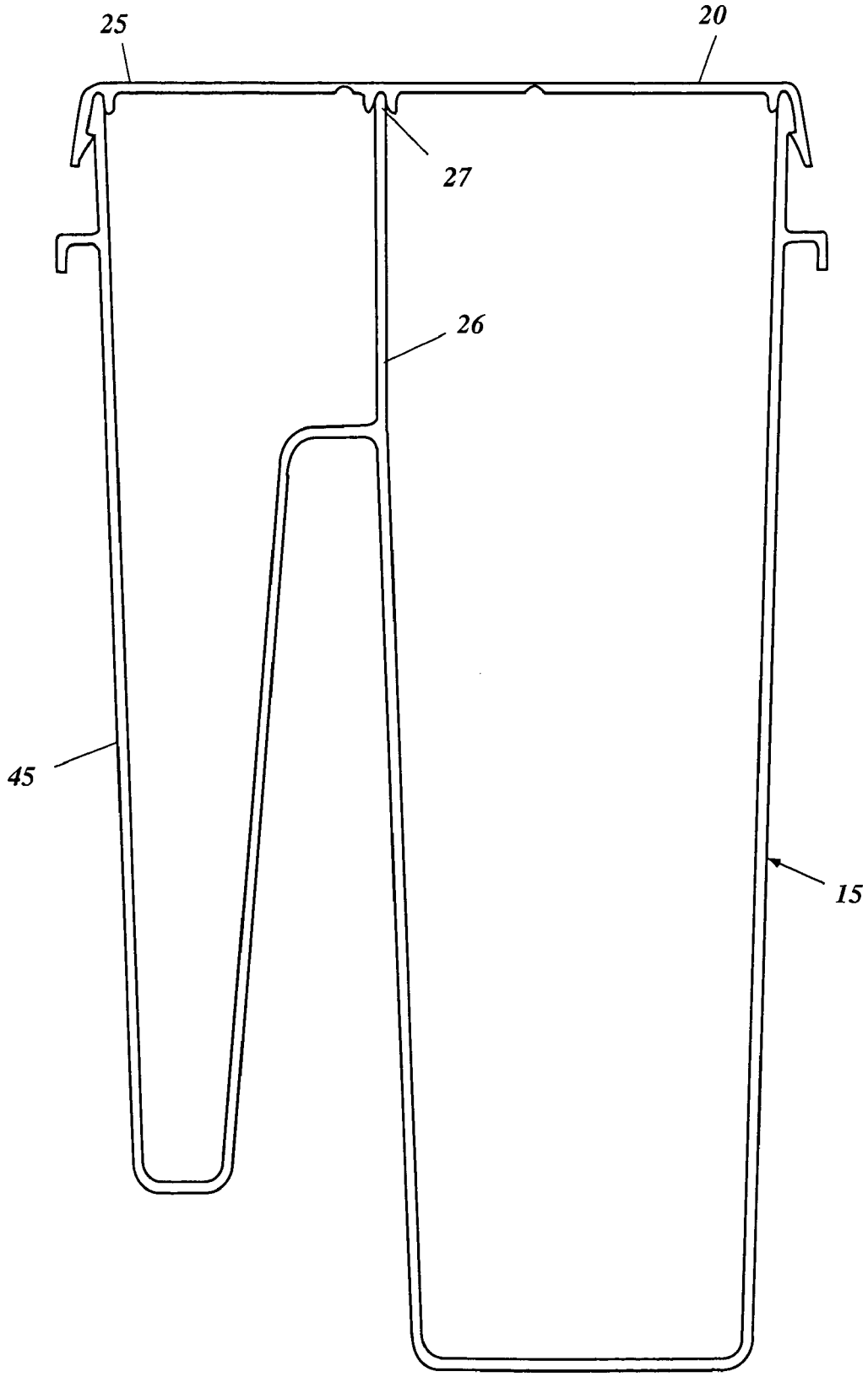
FIG. 15 is similar to FIG. 14, but shows the lid after removal of the tearstrip portions near each hinged opening, as the assembly would appear both prior to the initial opening of the hinged lid portions and after subsequent closure of those portions.
Figure 16:
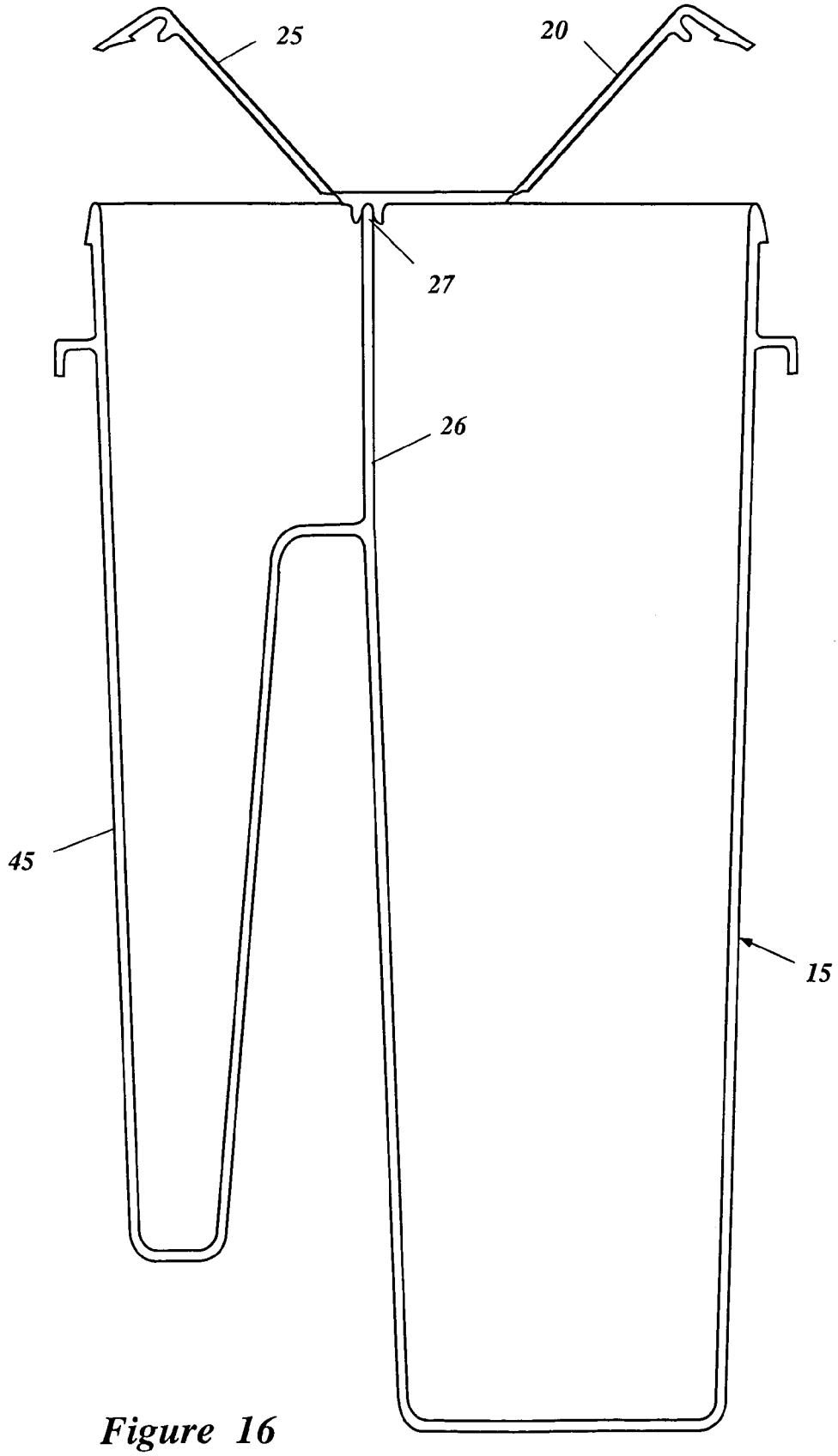
FIG. 16 is similar to FIG. 15, but shows the hinged portions in an open position.

The cover 10 preferably includes tamper-evidencing structures, such as assembly 30 including tear strip 35. Preferably, the tear strip 35 is provided with a ring pull device 40 or like feature to provide a convenient tab for gripping the tear strip 35 when opening the container or otherwise separating the cover 10 from the container 15. In the embodiment of FIGS. 1-5, just the corners of the lid (over the handle and opposite thereto) are provided with tearstrip portions, so that the rest of the lid typically stays engaged with the container after the initial opening. As shown in FIG. 1, the tamper evident assembly 30 preferably is positioned along the perimeter of the cover 10. Alternatively, the tamper evident assembly 30 may occupy another section or sections of the cover 10. FIGS. 2 and 3 (and FIGS. 14-16) illustrate how removal of the separate tear strips 35 (on each of the two aforementioned corners) facilitates opening/closing of the pour feature 20 and hinged handle cover 25 located at those corners. Persons of ordinary skill in the art will understand that, among the many embodiments of the invention, the invention may be practiced with no tearstrips, multiple tearstrips at certain "liftable" sections and none at others, or any useful combination or arrangement thereof.

Figure 21A:
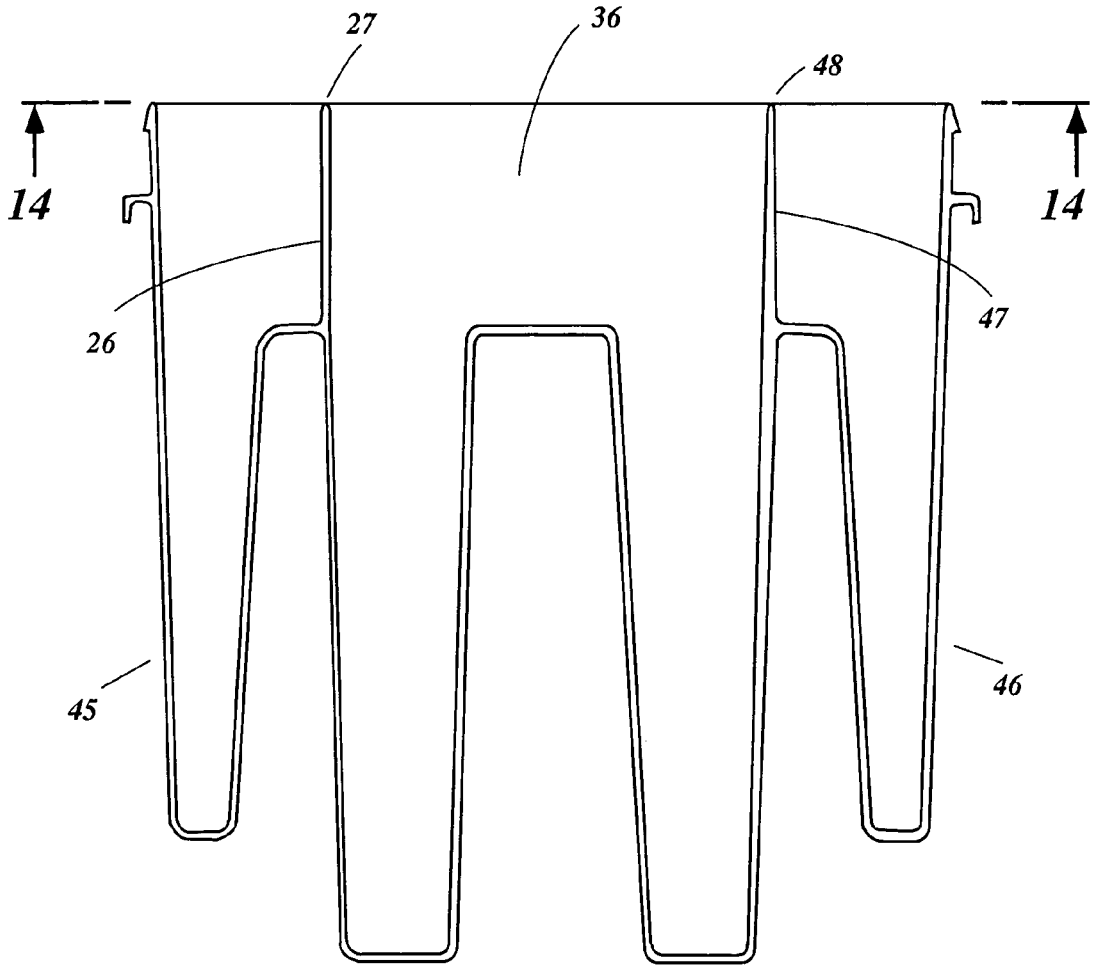
FIG. 21A illustrates another of the many alternative embodiments of the invention, and is a corner to corner section view similar to FIGS. 17,19A, showing a nestable container with multiple container chambers and multiple handle chambers (one on the right side and one on the left).

Preferably, the container 15 includes a plurality of chambers or compartments configured to be nestable with other like containers when empty. The wide variety of chamber configurations can include a main chamber 16 and a handle 45 for carrying, pouring, or otherwise manipulating the container assembly 5. Additional bails or similar "loop" or other handles (not shown) may also be provided, such as ones that may be conveniently pivotably attached to the upper portion of opposed sidewalls of the container 15. Persons of ordinary skill in the art will understand that, in addition to the "one handle" embodiments shown in the drawings, the invention can be practiced with multiple handle chambers (such as handle chambers 45 and 46 in FIG. 21A-21D), positioned at various locations within or around the container structure (including at locations other than at opposite corners), with multiple "non-handle" segregated storage chambers (such as chambers 17-19, 36-38, and 41-43 in FIGS. 21B-21D), or various combinations thereof. The chambers formed within the container can take a wide variety of sizes and shapes (such as chamber 36 in FIG. 21A, chamber 18 in FIG. 21B, and chambers 37 and 38 in FIG. 21C), as can the overall container itself.

Preferably, for embodiments having at least one of the compartments formed as a handle section 45 in the container, that section constitutes a usable compartment or chamber, which may be utilized for a wide variety of purposes and applications. Although it can be left empty (again, depending on the application), it can be used to hold and transport various items such as things that might be usable in some coordinated manner with the thing/substance in other compartments of the container. For example, a tool/paint brush/shovel/stirrer/mixer/etc. may be shipped within the handle chamber of the container, for use with the paint/bird seed/fertilizer/etc. in another chamber in the container. Alternatively, items such as those accessories (tool/paint brush/shovel/stirrer/mixer/etc.) could be acquired or provided separately by the final user of the container, and the user might simply find it convenient to store the tool/etc. in the separate handle storage compartment.

The items stored in the separate handle or other compartment in the container may be promotional in nature, may complement/supplement the materials or things in the main storage body portion of the container (including, by way of example, providing storage for the aforementioned tool/paint brush/shovel/stirrer/mixer/etc. useful with the material in the container's main body), or may be any of a wide variety of other things. By way of example and not by way of limitation, certain applications may require a user to mix two or more liquids, powders, or other materials "on-site", rather than having them premixed (prior to shipping). For such applications, the unmixed things can each be loaded into its own separate/segregated compartment, the lid assembled to the container, and the assembly shipped to a store or to the end user. When the user is ready, he or she can open the relevant compartments (preferably by unsealing and opening the hinged lid flaps overlying the relevant compartments) simultaneously or in a series of separate steps, pour out the desired amount of each material, and proceed with the application/use of those combined materials.

Figure 19A:
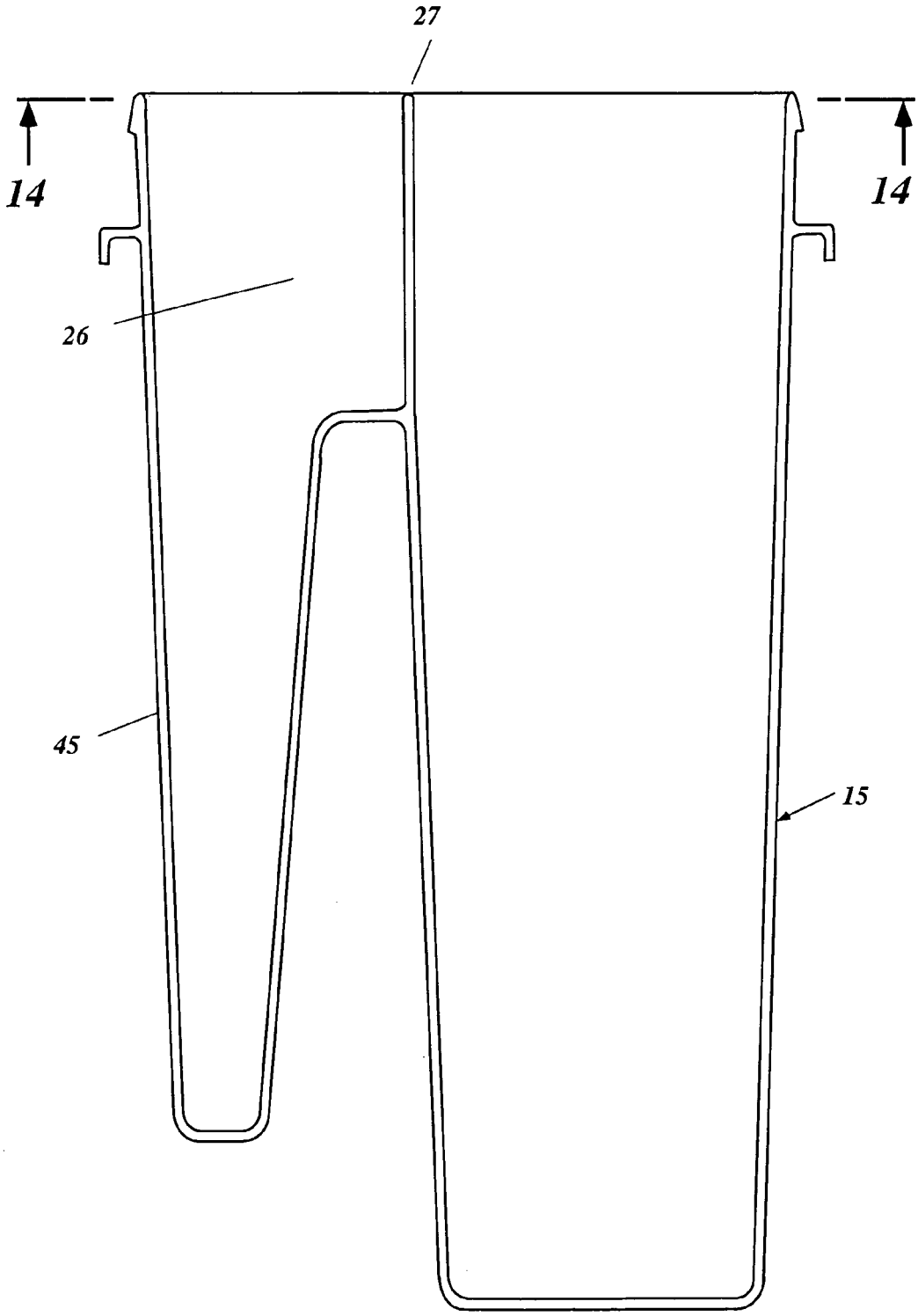
FIG. 19A is similar to FIG. 17 with a corner to corner view, but shows a container with a "full-height" interior wall to divide the handle chamber from the main container chamber.
Figure 19B:
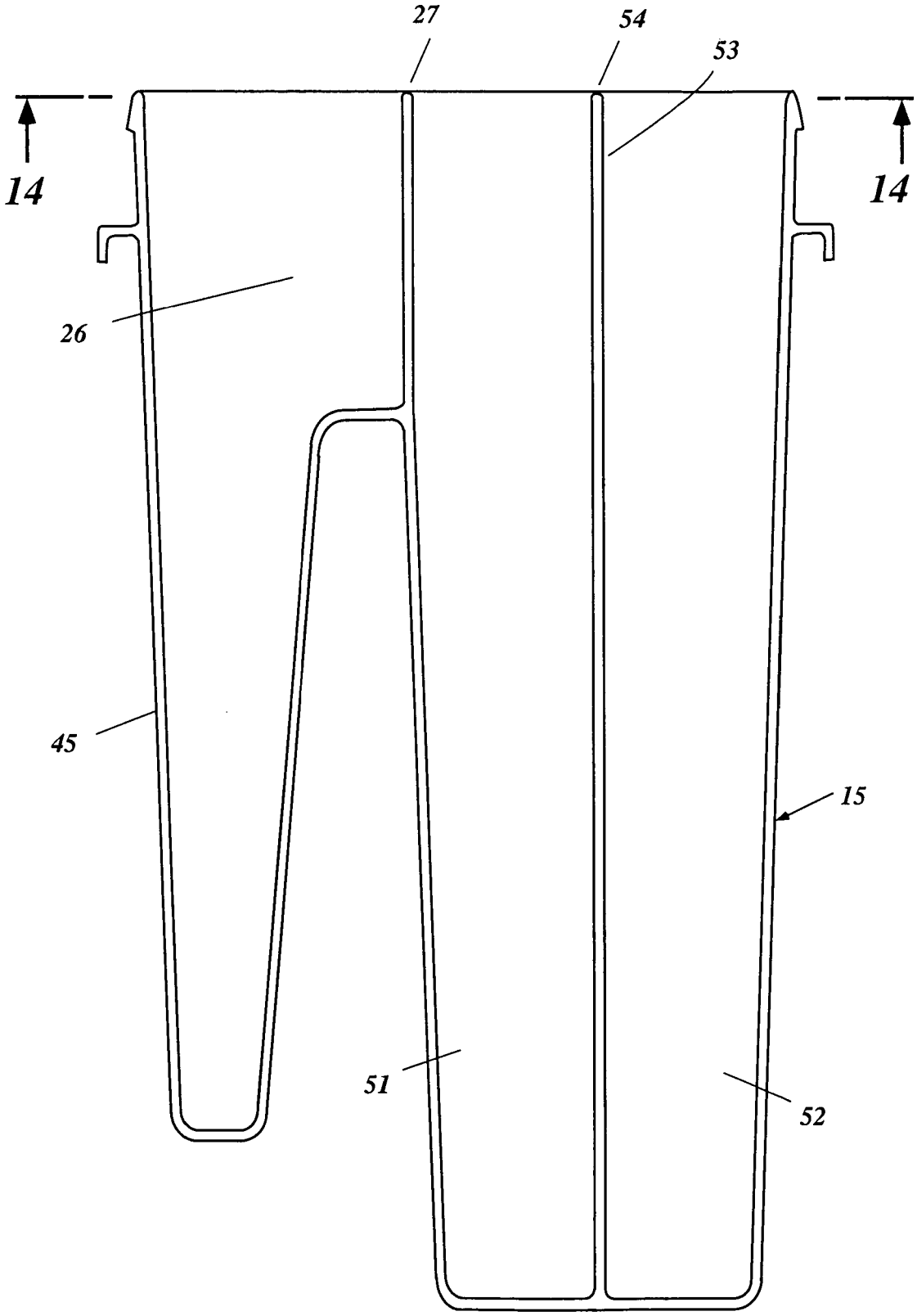
FIG. 19B is similar to FIG. 17 with a corner to corner view, but shows a container with a "full-height" interior wall to divide the handle chamber from the main container chamber, and with a "full-height" interior wall to define separate container chambers.
Figure 20:
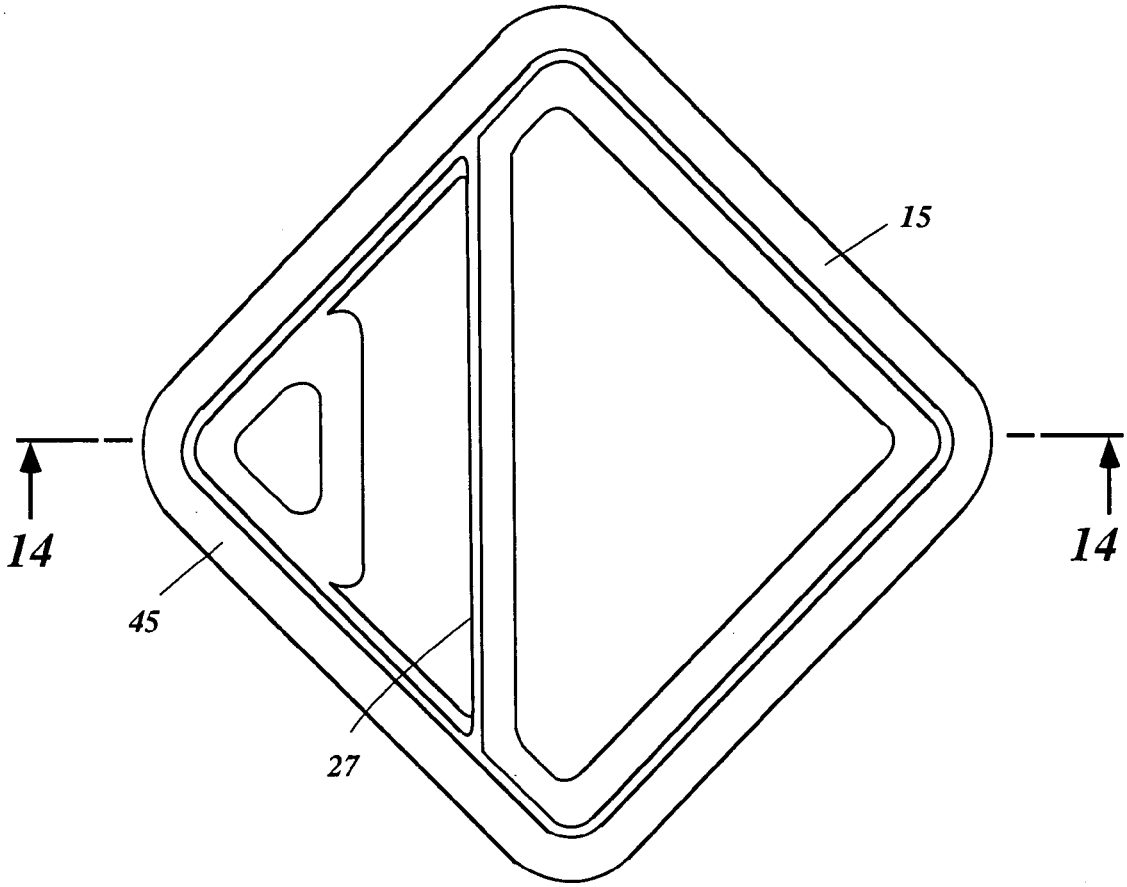
FIG. 20 is a top view of one embodiment of a container of the invention (similar to the container illustrated in FIG. 19A) without a lid on it.

In one preferred embodiment of the application, handle 45 and container 15 (FIG. 19A) will nest in similar containers without lids for ease in storage, packing, shipping and similar functions. Alternative embodiments for some applications of the invention may requiring multiple container chambers 51 and 52, FIG. 19B, divided by a "full-height" or other interior container divider which impedes the preferred nestability feature. Persons skilled in the art will recognize that multiple configurations (including diagonal, curved or other shapes and orientations and heights, etc.) of interior container dividers may be useful in other embodiments of the invention, despite their lack of nestability.

Figure 17:
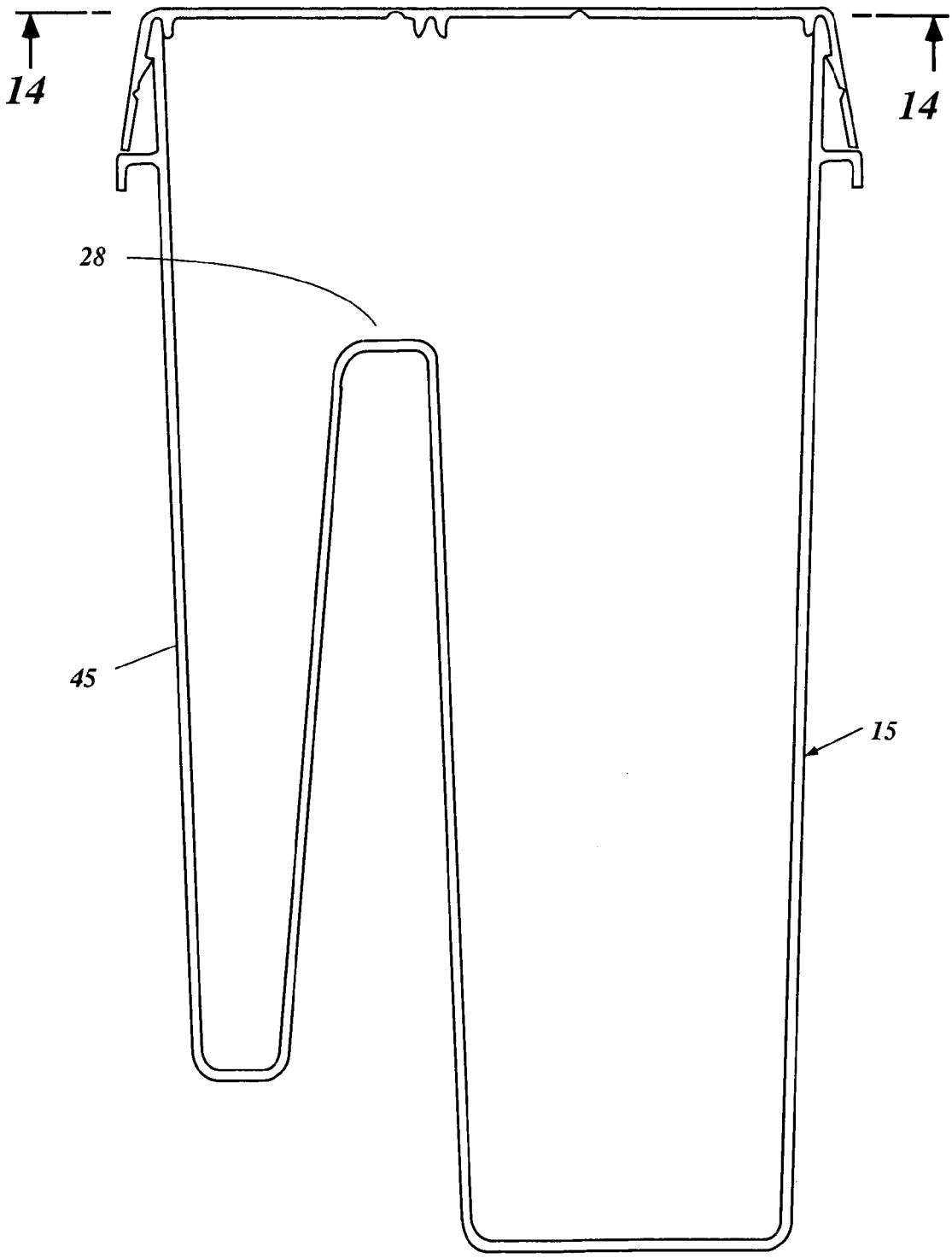
FIG. 17 is similar to FIG. 14 but shows a container without a "full-height" interior wall to divide the handle chamber from the main container chamber.
Figure 18:
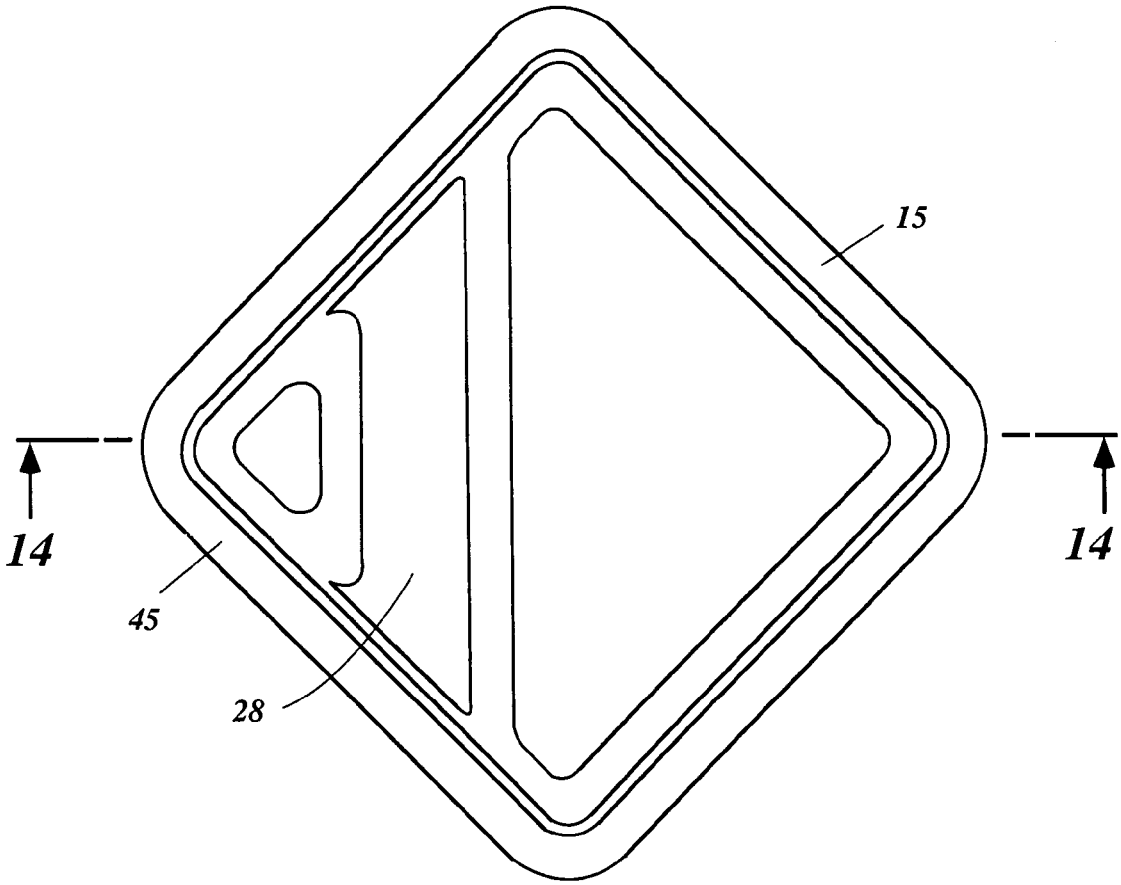
FIG. 18 is a top view of one embodiment of a container of the invention (similar to the container illustrated in FIG. 17) without a lid on it.
Figure 21B:
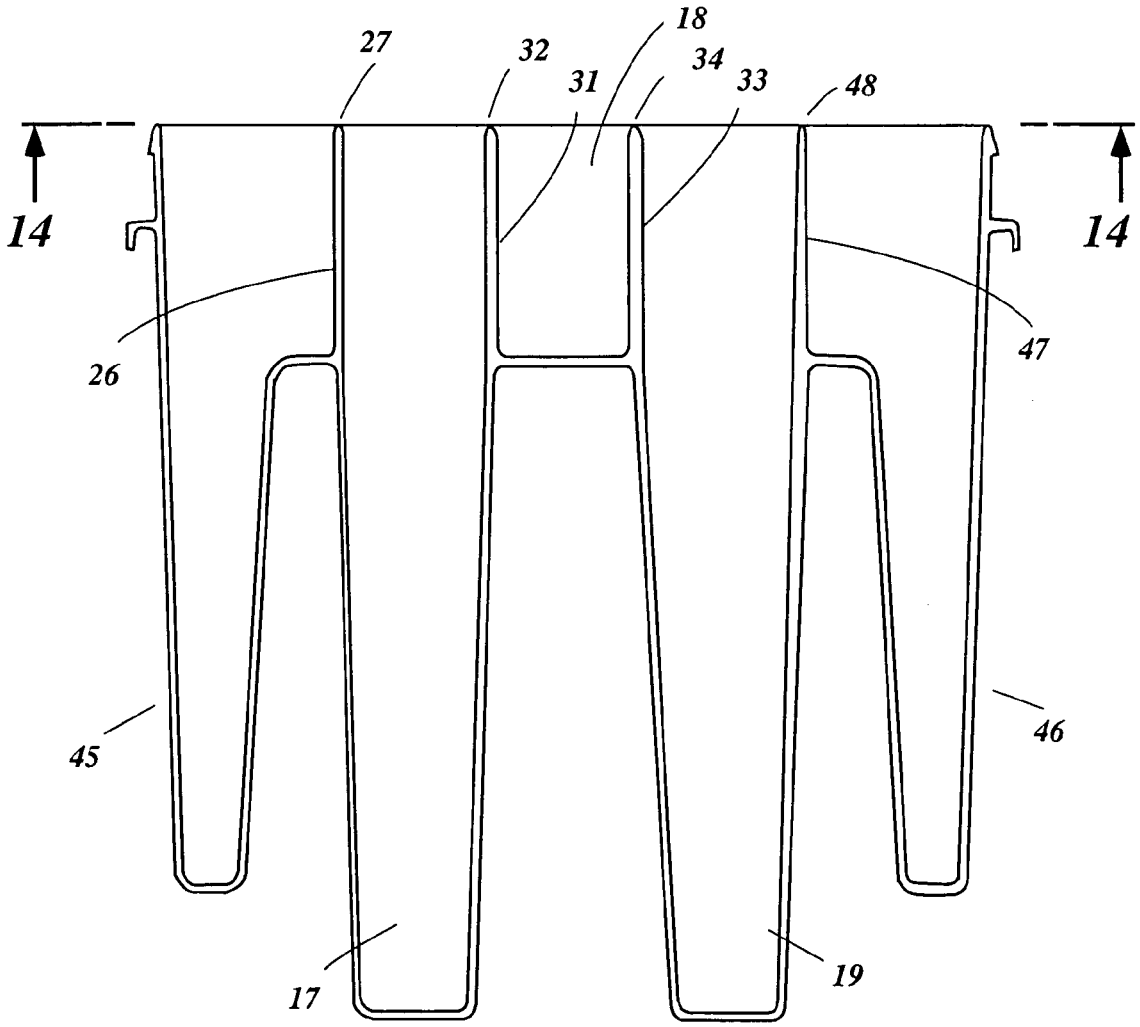
FIG. 21B illustrates another of the many alternative embodiments of the invention, and is a corner to corner section view similar to FIG. 21A, showing a nestable container with multiple "full-height" interior walls to define separate container chambers of varied depths and multiple handle chambers (one on the right side and one on the left).

Examples of other of the many embodiments of the invention include, not by way of limitation, embodiments with multiple handles (as mentioned elsewhere herein), such as illustrated in FIGS. 21A through 21D. As shown in that FIG. 21 (illustrating two handles, although more handles could be provided), a first handle 45 and a second handle 46 may be separated from the main or "non-handle" container chamber(s), such as chamber 36 in FIG. 21A, by "internal" dividers 26 and 47 (in other alternative embodiments—not shown—the dividers 26 and 47 can be omitted, such as the embodiment of FIG. 17 has no such divider). Those dividers 26 and 47 can be provided with upper edges 27 and 48 that sealingly engage the lid and thereby provide sealing separation between the hollow handle portions 45/46 and the non-handle storage chambers 17-1936-38, and/or 41-43 of the container (as explained below) or from a single main storage body 65 for embodiments not having any further internal dividers such as dividers 31 or 33 (FIG. 21B).

As indicated above, such multiple handle embodiments may also be configured without the dividers 26 and 47, and may instead simply include a land 28 (similar to FIG. 17) at that location (between the handles and the main storage body 36 or 65, FIG. 4, or multiple chambers 17,19, 37, 38, 41, or 43), so that the handle portions are not sealingly separated from the non-handle chamber(s). Persons skilled in the art will recognize that such multiple handle elements may be located at two or more opposite corners or adjoining corners of the container, depending on the desired application.

Figure 21C:
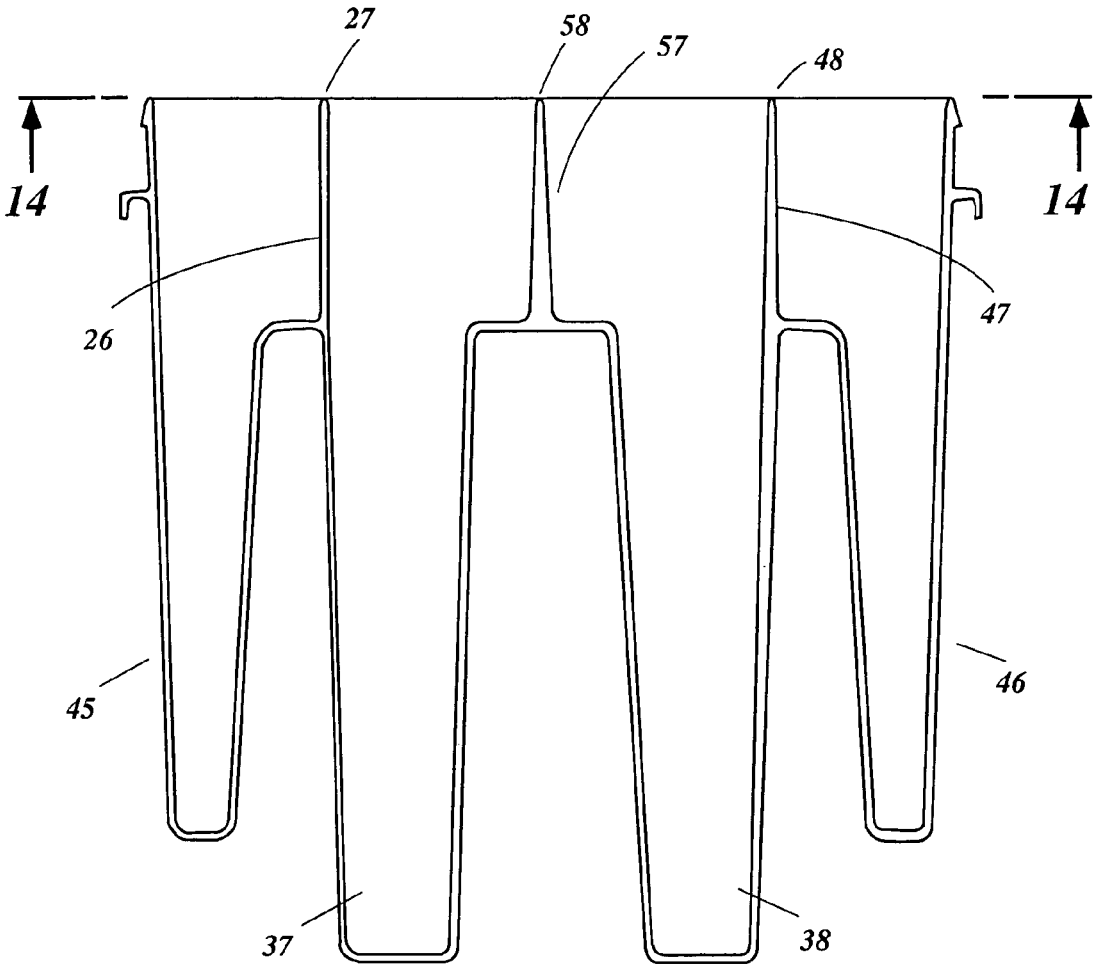
FIG. 21C illustrates another of the many alternative embodiments of the invention, and is a corner to corner section view similar to FIG. 21B, showing a container with a single "full-height" interior wall to define separate right and left side container chanbers, and multiple handle chambers (one on the right side and one on the left).
Figure 21D:
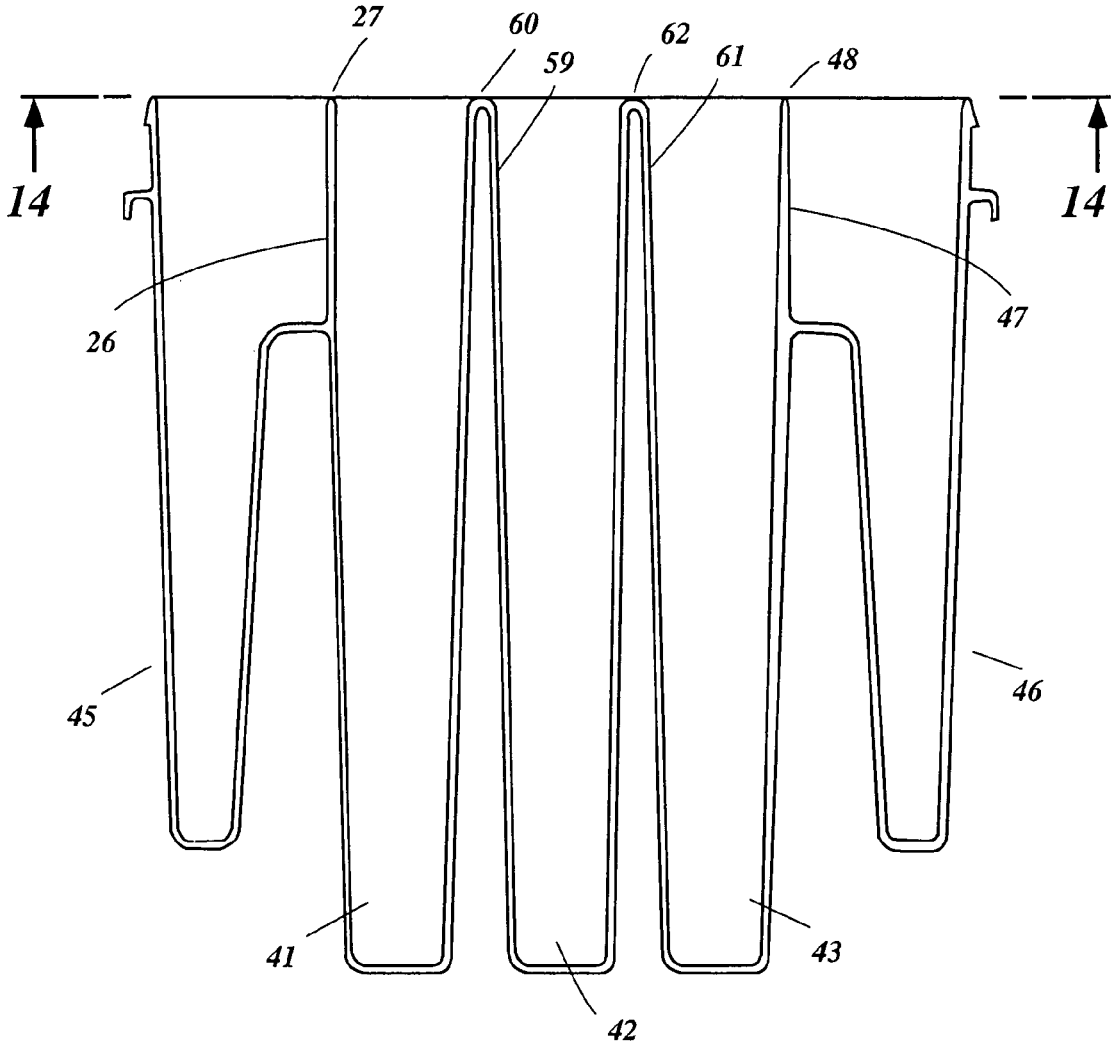
FIG. 21D illustrates another of the many alternative embodiments of the invention, and is a corner to corner section view similar to 21C, showing a container with multiple double-walled "full-height" interior container chambers and multiple handle chambers (one on the right side and one on the left).
Figure 22:
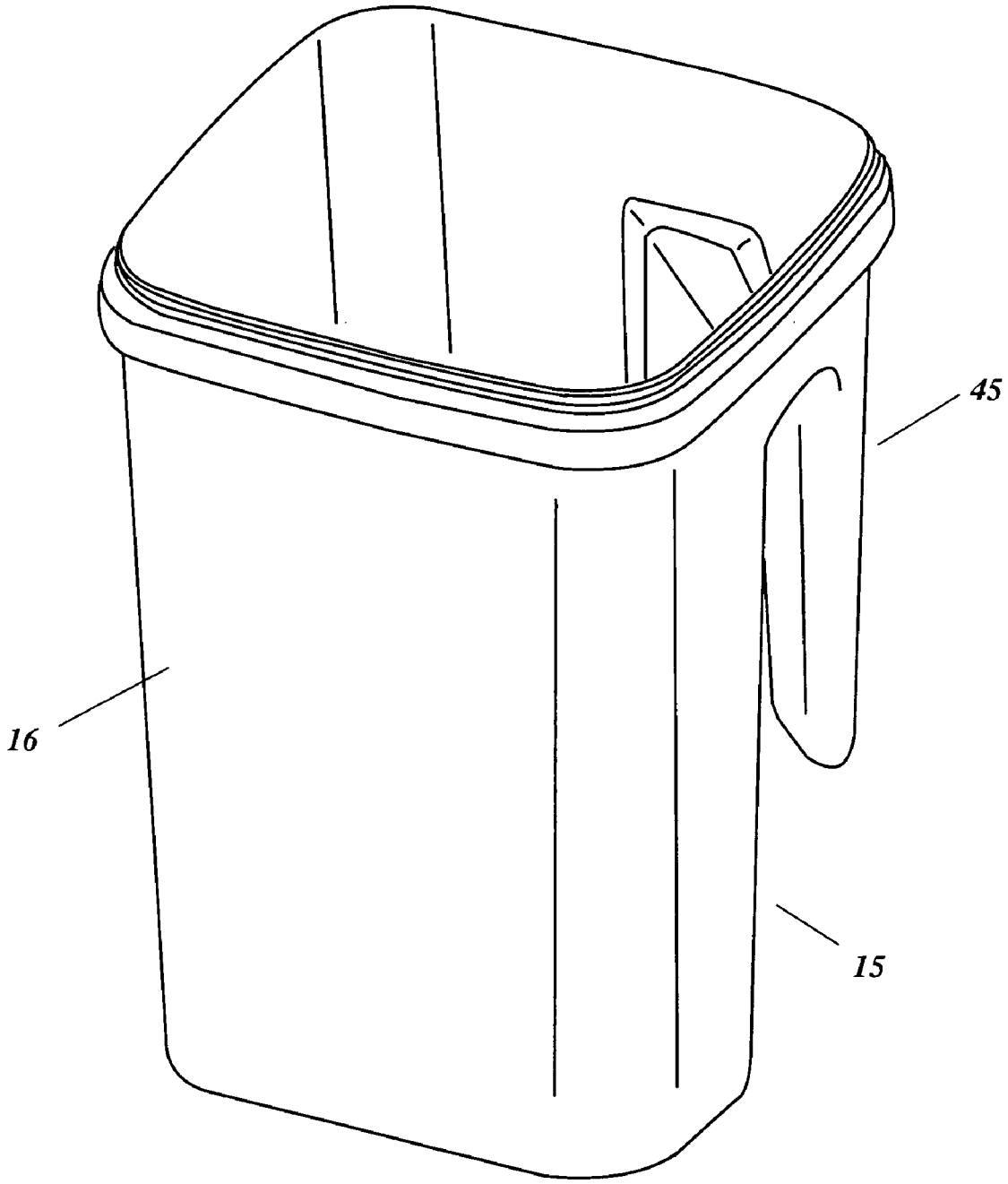
FIG. 22 is a perspective view similar to FIG. 4, but shows the container of FIG. 17 (without a "full height" internal divider structure).

Other aspects of alternative embodiments are also illustrated in FIGS. 21B-21D, such as dividing the non-handle compartment (such as main chamber 65 shown in other FIGS.) into multiple chambers of varying depth 17, 18, and 19, or multiple chambers of varying size and shape which comprise less than the entire area within a planar area positioned downward from the outside perimeter of the container cover 37 and 38. Multiple chambers may also be formed by other means, including for example inverted v or double-walled interior dividers 59 and 61, FIG. 21D. As shown in FIG. 21, the internal chamber dividers preferably are generally parallel in a vertical plane to the handle dividers, and the resulting chambers 17, 19, 37, 38, and 41-43 are generally of similar size and shape. Persons of ordinary skill in the art will understand, however, that the number and relative size/shape/position/orientation of such separate chambers can vary widely, and still provide one or more of the benefits of the invention. For any such embodiments in which the application needed to use a single lid for all such chambers, the mating relationship between the lid and the chambers would need to be coordinated. Access mechanisms or means such as the tabs or tearstrips discussed in connection with other FIGURES herein may be provided for any or all of the various chambers so formed.

Other "multiple non-handle compartments" embodiments may use one or more dividers that are oriented at right angles to those shown in FIGS. 21B-21D (so that they would stand generally along a vertical plane on the diagonal axis between a handle corner and the opposite corner (running in the plane of the paper as you view FIG. 14 or FIGS. 21B-21D, for example). Most or all of such embodiments can be configured so that either all or a combination of multiple things could be selectively poured from or otherwise accessed separately from the container, by using the handle (in the natural pouring motion described herein) or by some other manipulation of the container. Persons skilled in the art will recognize that multiple configurations (including diagonal, curved or other shapes and orientations and heights, etc.) of dividers may be useful in other embodiments of the invention.

Persons of ordinary skill in the art will understand that the invention can be practiced in a wide range of embodiments that can vary substantially regarding their degree of nestability with like containers. For example, a higher degree of nesting (more containers stacked together in a given volume) may be available for embodiments not having the full height separating partitions, such as dividers 26 and 47, FIG. 21A.

Figure 4:
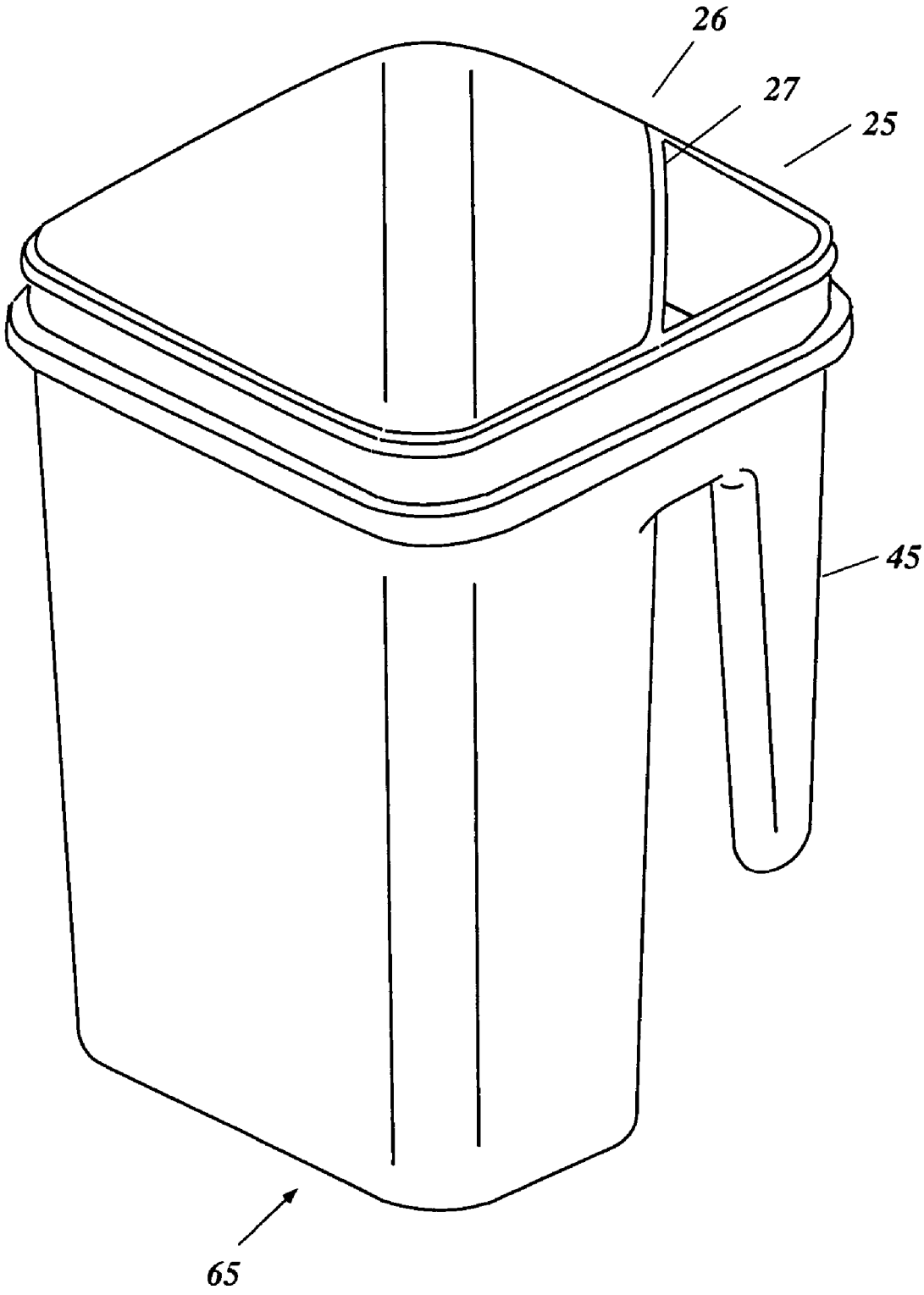
FIG. 4 is a perspective view similar to FIG. 1, but shows just the container of FIGS. 1-3. Preferably, and as further explained below, an internal divider 26 is provided (preferably integrally formed in the container itself) with an upper edge that can engage the associated lid and thereby provide sealing separation between the hollow handle 45 and the main storage body 65 of the container.
Figure 14:
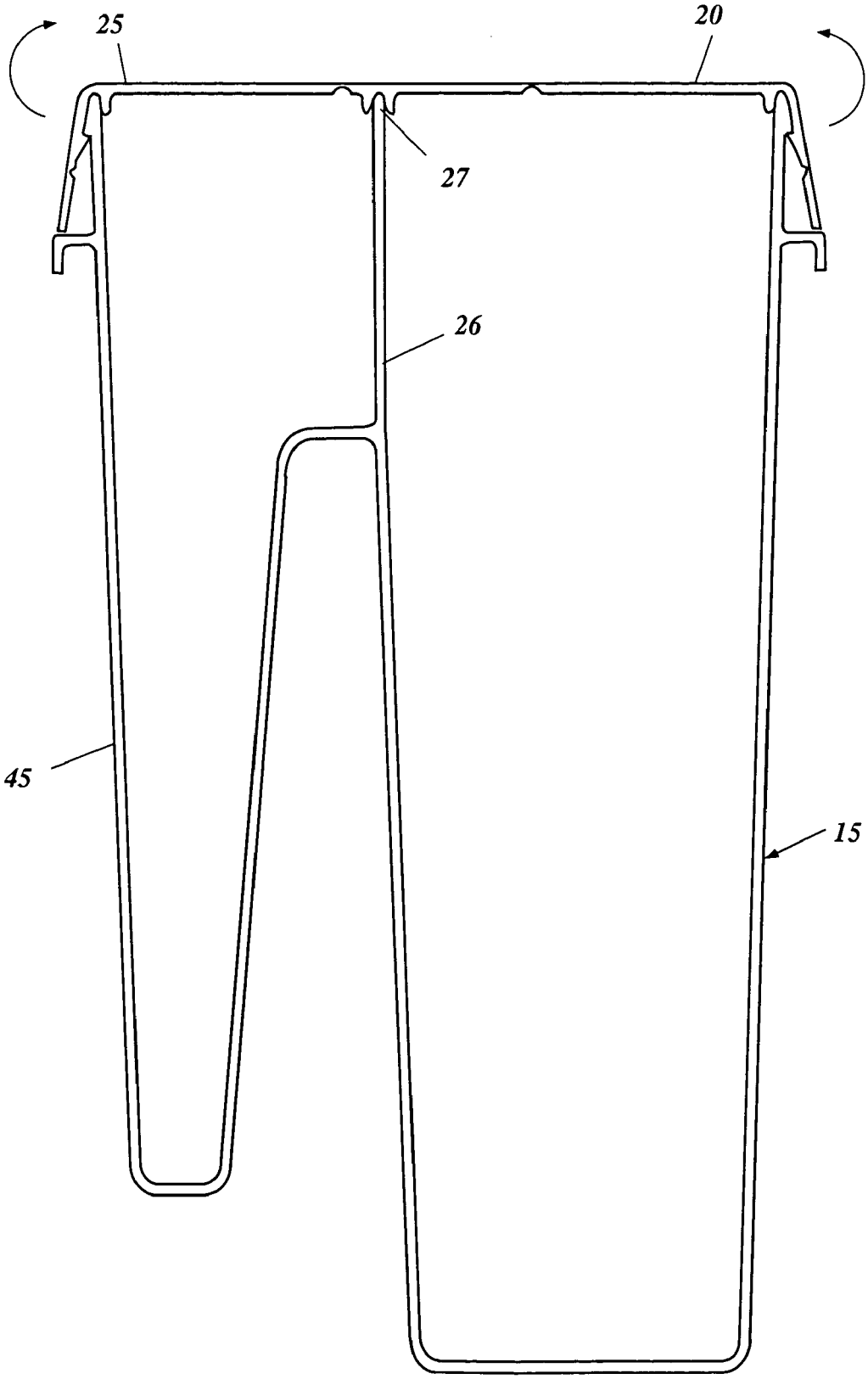
FIG. 14 is similar to FIGS. 12 and 13, but is a sectional view such as might be taken along line 14-14 in FIG. 13 if the lid had not yet had its tearstrips removed and been opened.

Preferably, and as shown in FIGS. 4 and 14, an "internal" divider 26 is provided (preferably integrally formed in the container itself) with an upper edge 27 that sealingly engages the lid and thereby provides sealing separation between the hollow handle portion 45 and the main storage body 65 of the container.

In certain applications, the items stored in the handle 45 may be similar or identical to those items or material(s) stored in the main container chamber 16. On the other hand, and as mentioned above, the handle 45 may store a thing or material that is intended for use with the material stored in the main container 16, but must be kept separate until ready for the materials intended use. For example, the mixing of peat moss with a chemical additive such as lime may not be appropriate until the mixture is actually going to be applied to landscaping or a garden area, or until the desired amount/ratio of constituents can be determined (at the time of application to the garden/plants/etc.).

As illustrated in FIG. 2, the hinged handle cover portion 25 of the lid preferably is configured and positioned to facilitate access to the optional storage area located within the handle 45. The hinge handle cover portion 25 preferably is hinged (but may alternatively be removably attached or otherwise connected) to the rest of the cover 10, to provide access to the preferred storage space provided in the handle 45. Depending on the application, the lid flaps can be reclosed for future use of the materials in the container, by any suitable method or structure (such as interfering detents on the lid and container, etc.) In other words, the handle cover portion 25 may be reclosable (by snapping it back into engagement, consistent with the drawings of FIGS. 1-5) using hinge 50, or alternatively may be removed completely from the rest of the lid 50 (which would permit, among other things, storing or holding oversized items in the handle portion 45).

The cover 10 preferably also includes a built-in pour feature 20 positioned over the main chamber of the container. The pour feature 20 preferably is located at the opposite corner from the handle, so that lifting the container by the handle will permit a natural pouring of the contents from the main chamber out of the pour feature 20 (similar to pouring liquids from a pitcher). Similarly to the handle cover portion 25, the built-in pour feature 20 may be hinged 50 or adapted to be removably attached.

Figure 23:
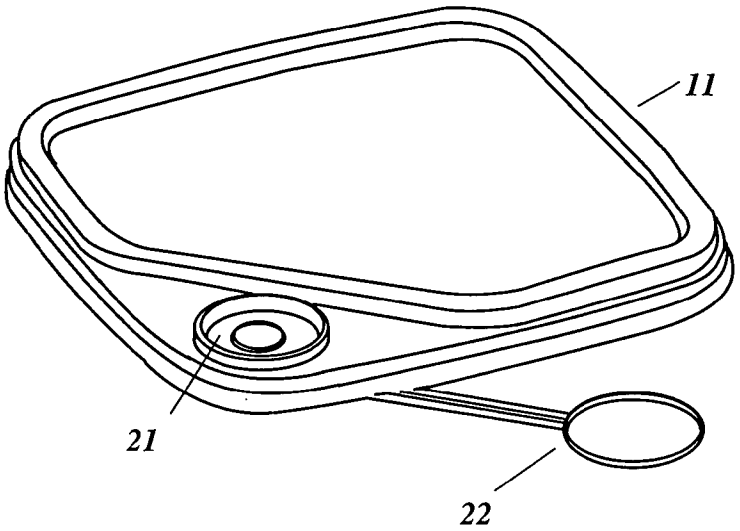
FIG. 23 is a perspective view of one of the many alternative embodiments of the invention, showing a container cover with a snap-on lid or cap molded integrally with the cover, showing that snap-on element in an open position.
Figure 24:
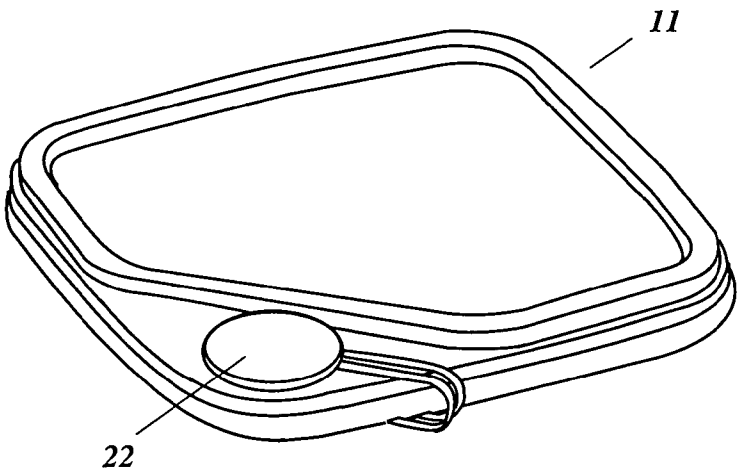
FIG. 24 is a perspective view the lid of FIG. 23, with the snap-on lid or cap in an closed position.
Figure 25:
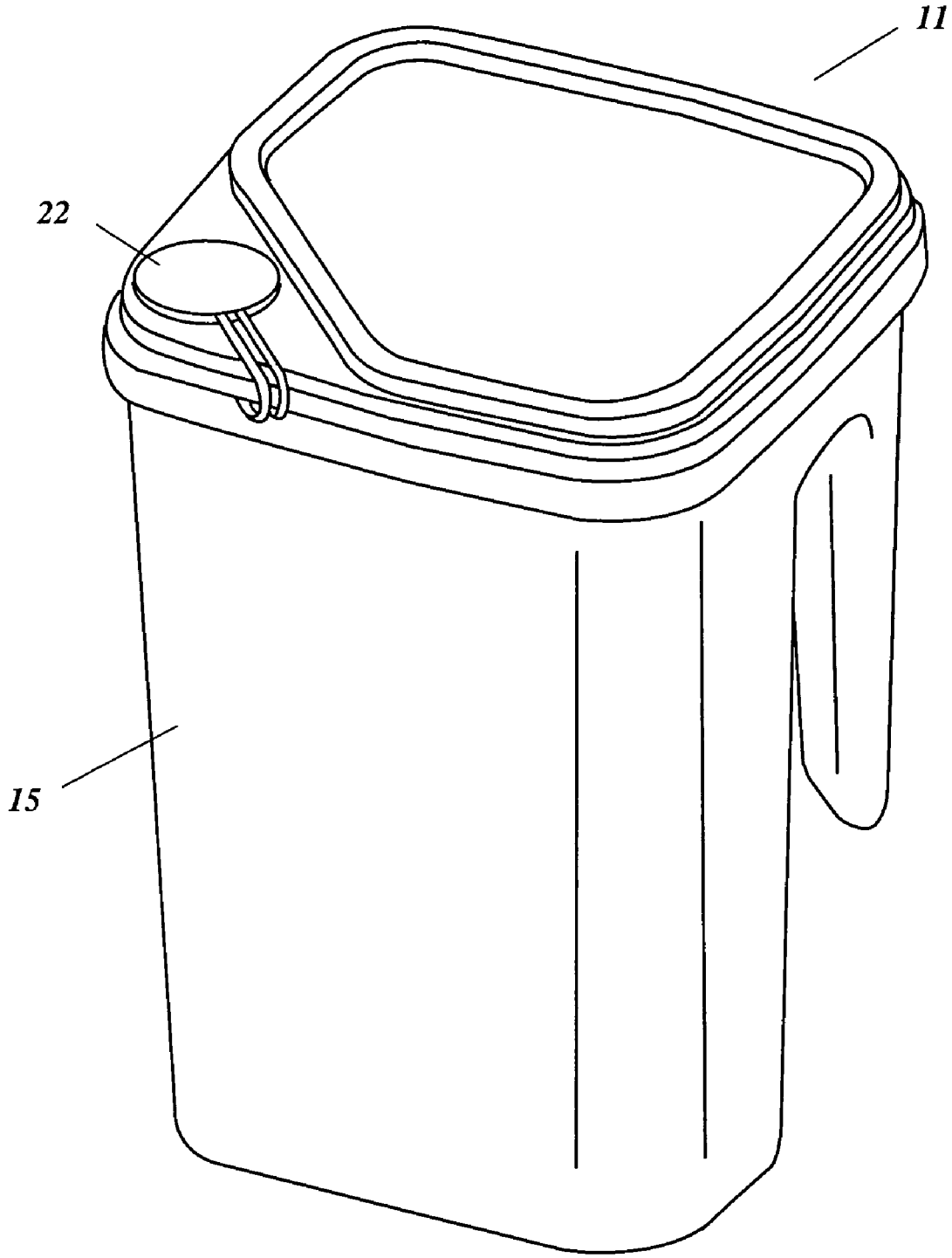
FIG. 25 is a perspective view of the cover of FIGS. 23-24 engaged with the container of FIG. 22.
Figure 28:
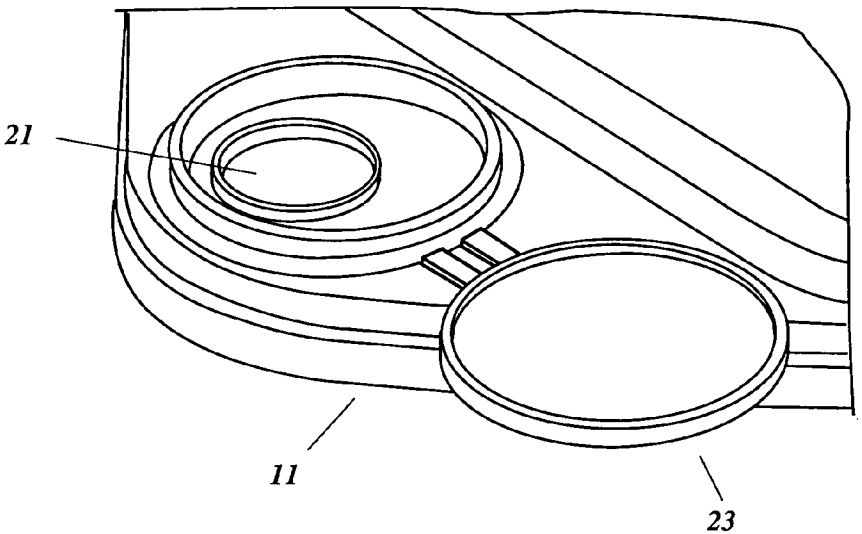
FIG. 28 is a perspective view of the lid or cap of FIG. 26, which has been affixed to the container cover, and is in an open position.
Figure 26:
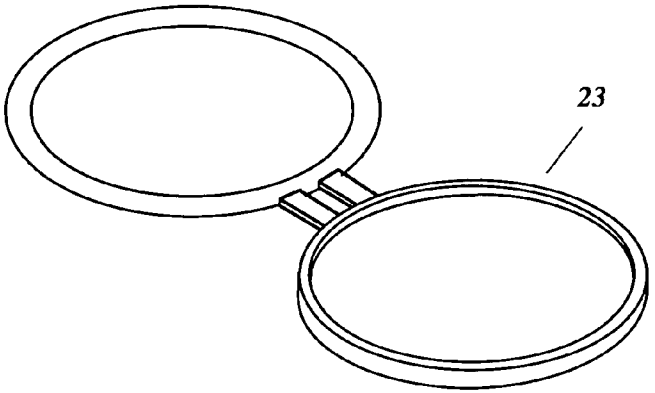
FIG. 26 is a perspective view of yet another of the many alternative embodiments of a snap-on lid or cap which can be molded separately and affixed in a suitable manner to the container cover.
Figure 27:
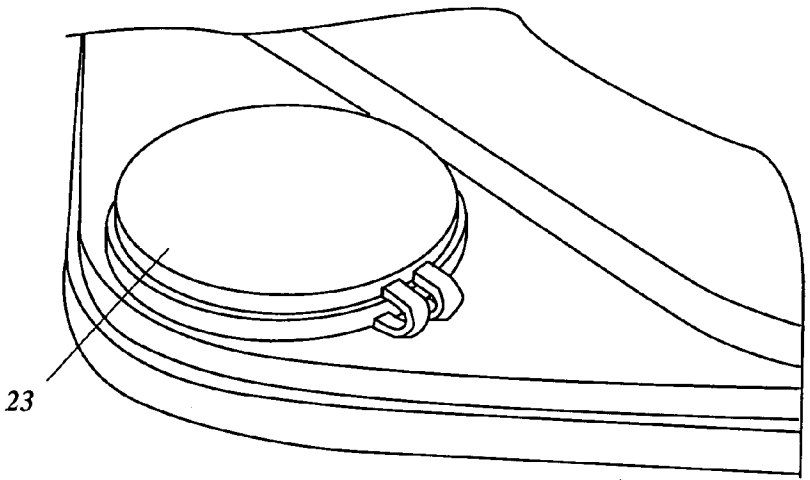
FIG. 27 is a perspective view of the lid or cap of FIG. 26, which has been affixed to the container cover, and is in a closed position.
Figure 30:
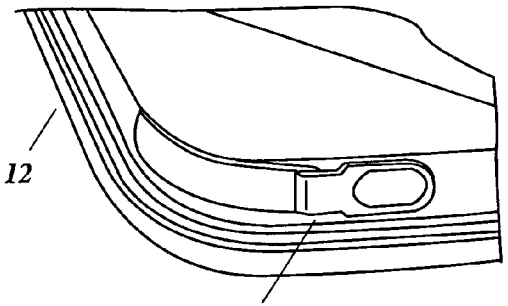
FIG. 30 is a partial perspective view of the "tearstrip" lid corner of FIG. 29.
Figure 31:
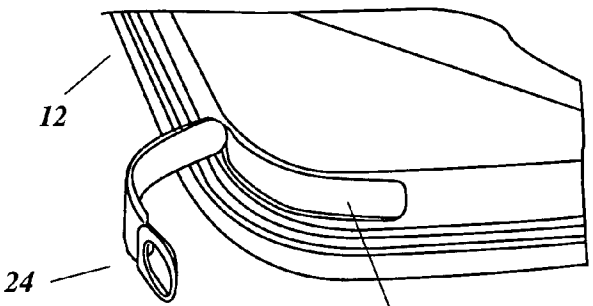
FIG. 31 is a perspective view similar to FIG. 30, showing the tearstrip in an open or partially removed position (other embodiments could include hinging the tearstrip in approximately the position shown here).
Figure 32:
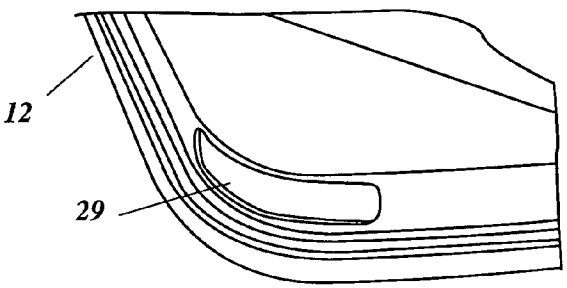
FIG. 32 is a perspective view similar to FIG. 31, but showing the lid with the tearstrip completely removed.
Figure 29:
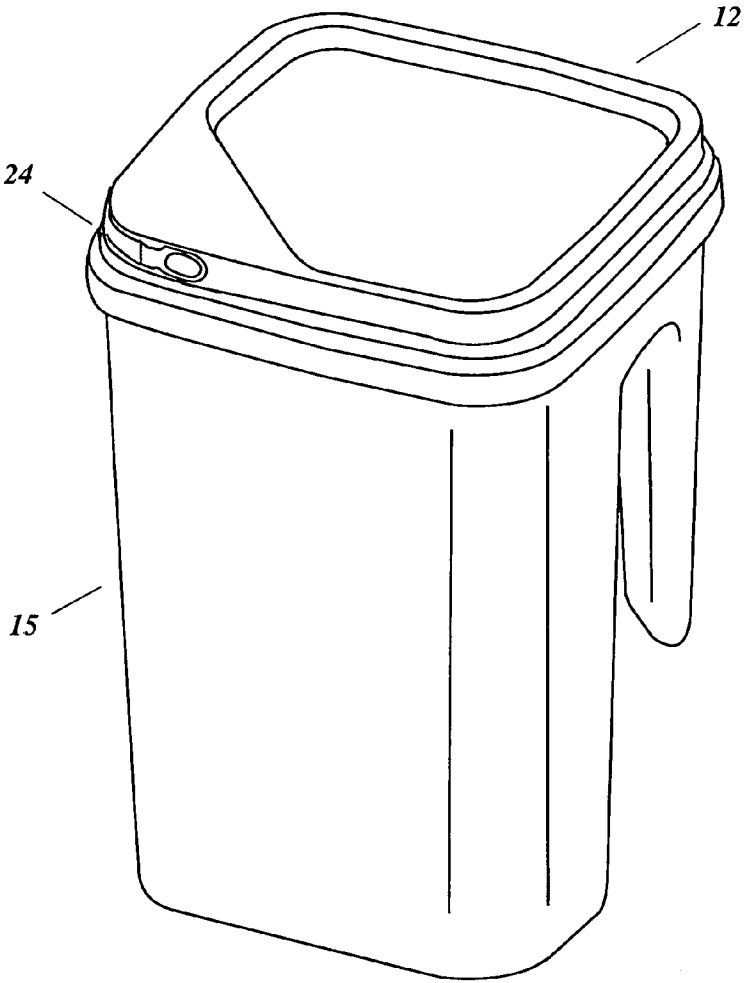
FIG. 29 is a perspective view of still another of the many alternative embodiments of the invention, showing a container and lid assembly with yet another of the many alternative access elements or structures that can provide access to the contents of the container, as a tearstrip opening included in the lid in a downwardly depending flange near one of the corners (but which could be included at multiple corners, in combination with other cap or tearstrip openings, etc.).

FIGS. 23 through 32 illustrate some of the many examples of the wide variety of embodiments of built in pour features that can be used with the invention. A relatively flat lid 11 with a built in pour structure 21 may incorporate a snap-on lid or cap 22, which can be molded integrally with the lid (as shown in FIGS. 23 through 25). A relatively flat lid 11 with a built in pour structure 21 may incorporate a snap-on lid or cap 23 molded separately and affixed in some suitable manner (see FIGS. 26 through 28). A contoured lid 12 incorporating a tearstrip 24 and corresponding tearstrip opening 29 can be included in the lid in a downwardly depending flange near one or more of the corners, as demonstrated in FIGS. 29 through 32. These and other alternatives can be used alone and/or in a wide variety of combinations to facilitate desired access to the contents of the container.

As indicated above, persons of ordinary skill in the art will understand that the cross-sectional shape of the container assembly 5 may be of a wide variety. For example, the container assembly 5 may be substantially square or rectangular (as shown in FIG. 1), triangular (not shown), or even circular (not shown). Furthermore, placement of the hinged handle cover 25 and/or built-in pour feature 20 may be adjacent to each other, opposite to each other, or at any point along the perimeter of the cover 10, among other configurations.

While handles are convenient for carrying or otherwise manipulating container assemblies such as various embodiments of the present invention, they can sometimes interfere with stacking or nesting of containers (such as if they extending outwardly beyond the sidewall of the container assembly, or otherwise extend the "footprint" of the assembly). In the present invention, the handle 45 preferably is formed within a convenient nestable and stackable "footprint" (as illustrated, a generally square footprint). Because the handle preferably is hollow and usable for storage, the handle does not constitute a space that is unnestable or otherwise unusable (and therefore arguably "wasteful"), as compared to other container/handle approaches. In other words, to provide a normal, non-storing handle in the space/footprint of the main container storage body takes up space that could otherwise be used for storing/transporting a packaged material or thing. The preferred embodiment of FIG. 1 offers benefits of both points the handle can be used for storage but also is within a stable/desired/easily stackable "footprint" of the container. Among other things, this aspect of the invention can permit and/or facilitate efficient side-by-side packaging of substantially similar container assemblies 5.

In addition, the preferred embodiment of FIGS. 1-5 includes some detent or other deformation to engage like containers when stacked, such as a raised cover portion 55 (and the alternative embodiment of FIGS. 6-10 includes a cover recess portion 60) located along the cover/lid 10. Other than that difference (raised vs. recessed cover portion), the foregoing comments regarding FIGS. 1-5 are generally applicable to FIGS. 6-10 as well.

Figure 5:
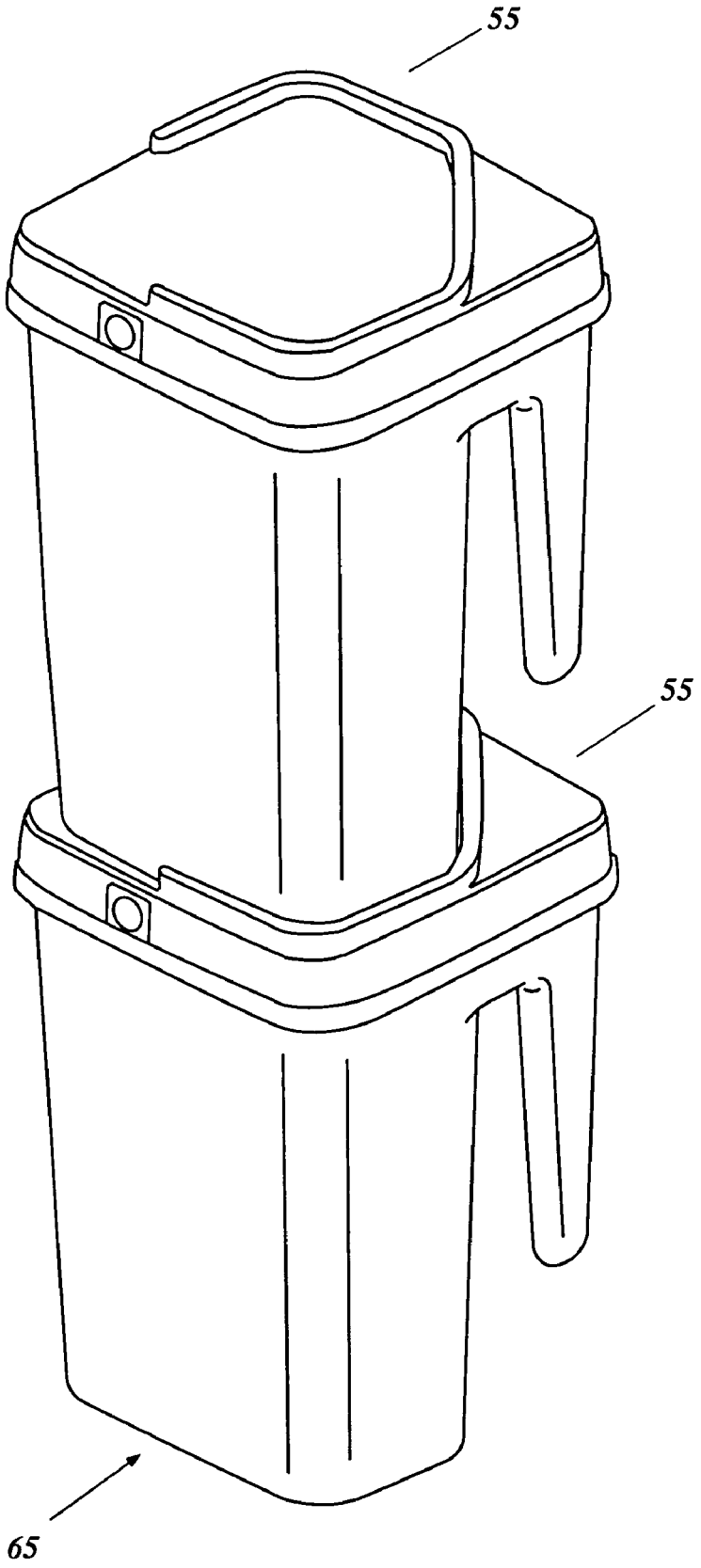
FIG. 5 is a perspective view similar to FIG. 1, but shows two of the embodiments of FIGS. 1-4 stacked together. Persons of ordinary skill in the art will understand that, among other things, the preferred ridge 55 on the lid enhances the stability of stacking, by providing greater engagement/interference between stacked containers (thereby better protecting against horizontal shifting between containers, for example).
Figure 6:
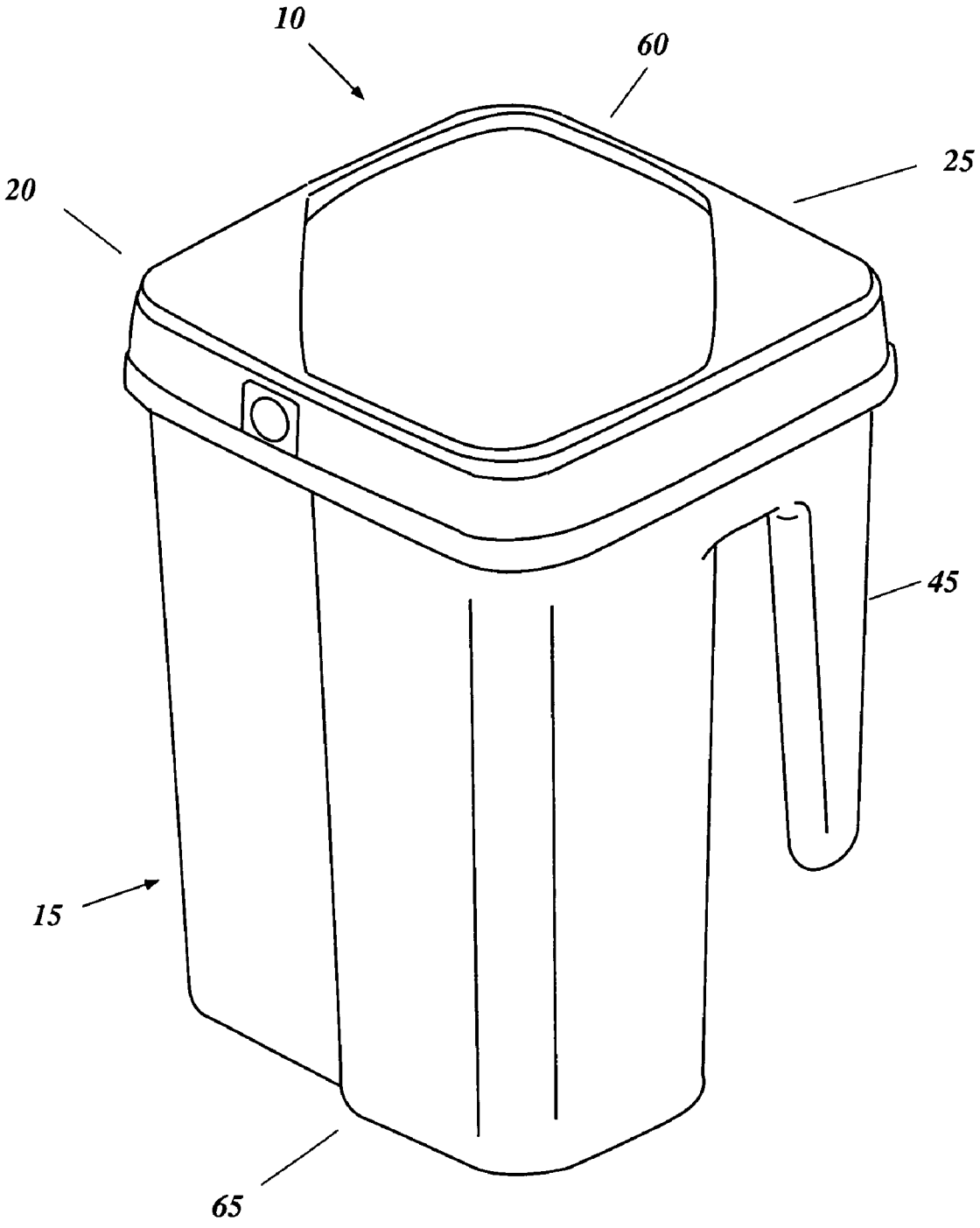
FIG. 6 is a perspective view of one of the many alternative embodiments of the invention, showing a recessed cover portion and corresponding recessed container bottom.
Figure 8:
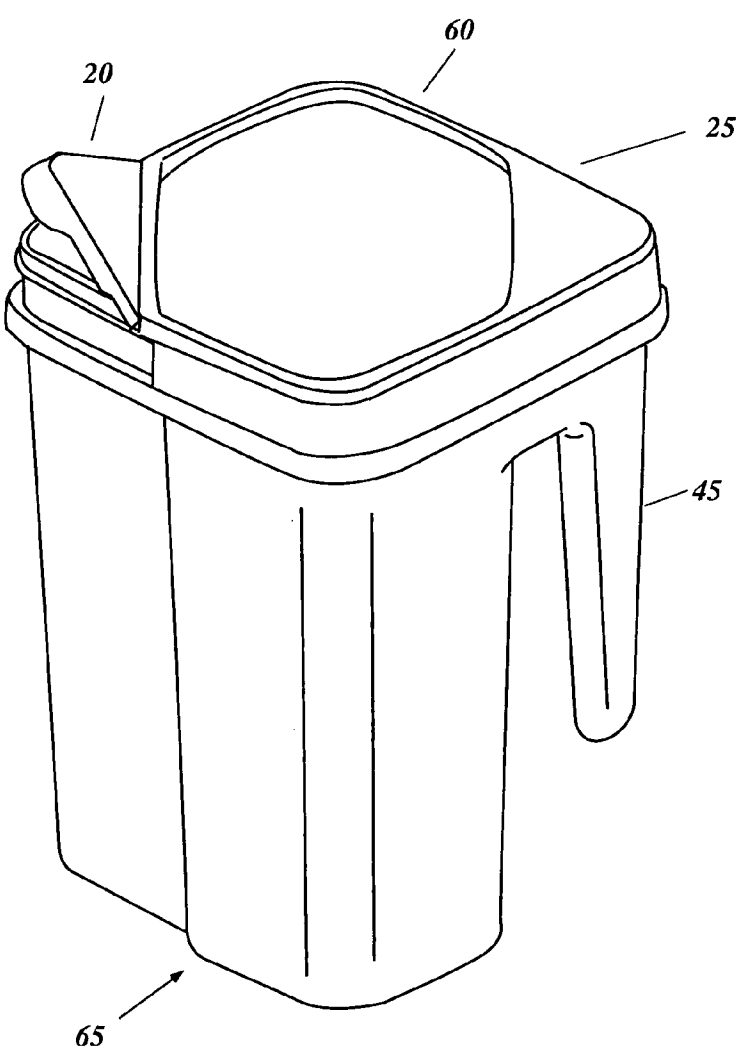
FIG. 8 is a perspective view similar to FIG. 7, but shows the built-in pour feature in an open position.
Figure 7:
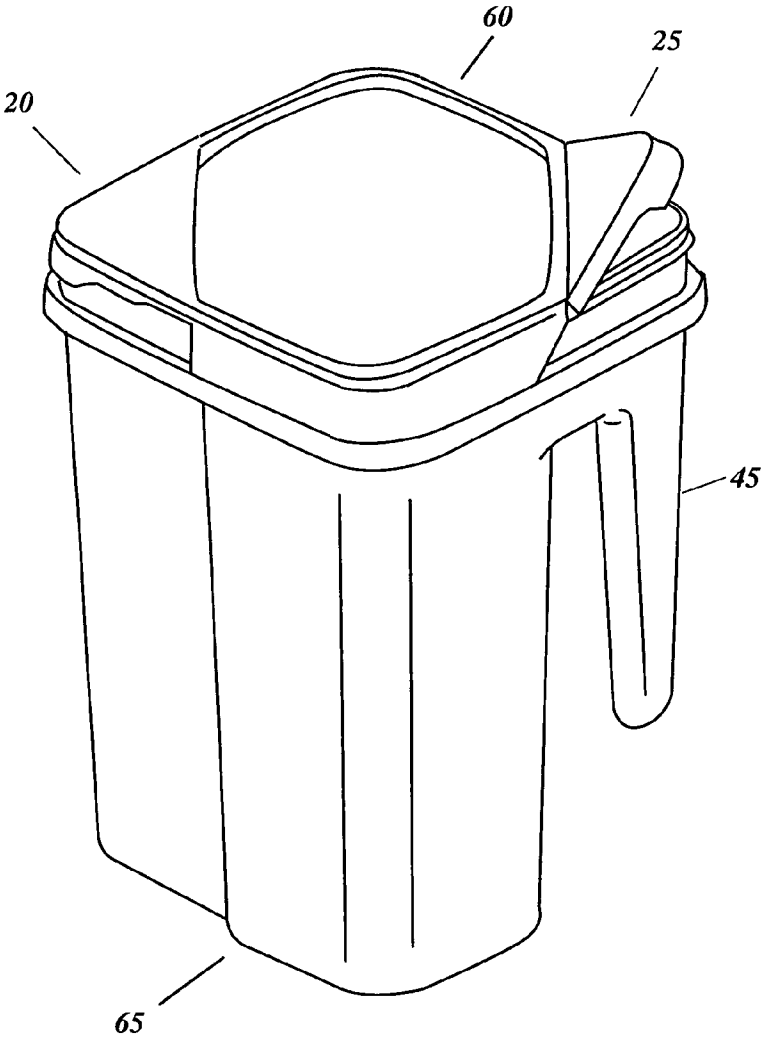
FIG. 7 is a perspective view similar to FIG. 6, but shows the hinged handle cover portion in an open position, and tear strip removed.
Figure 10:
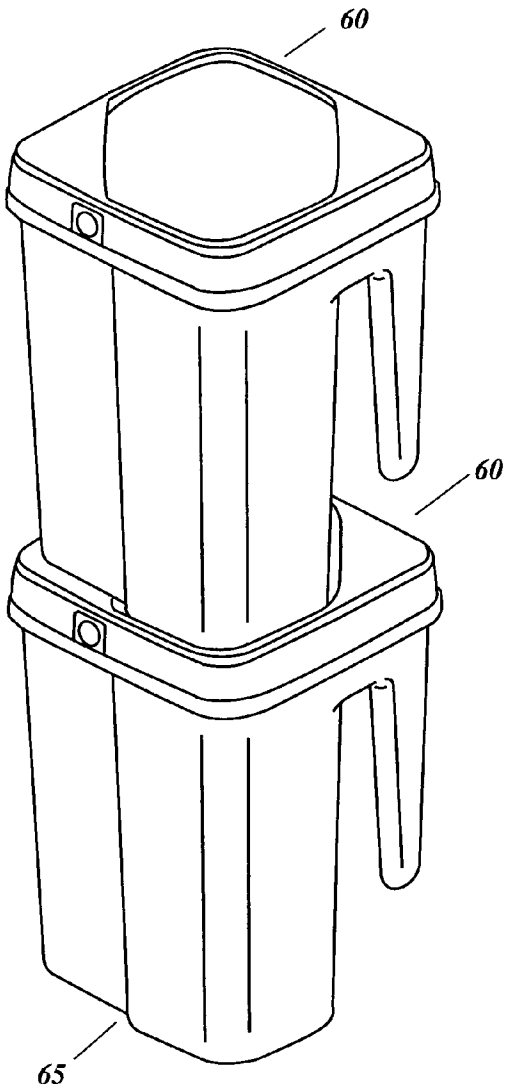
FIG. 10 is a perspective view similar to FIG. 1, but shows two container/lid assemblies of FIGS. 6-9, as they may be stacked together.

For either approach (FIG. 1-5 or 6-10), the container preferably is correspondingly shaped to engage that raised/recessed portion during stacking, to improve the stability of such stacks. Preferably, all such raised/recessed portions of the lids/containers facilitate nesting of like components prior to assembly thereof (or after separation of the lid from the container). Stacking of substantially similar container assemblies is shown in FIGS. 5 and 10.

Figure 9:
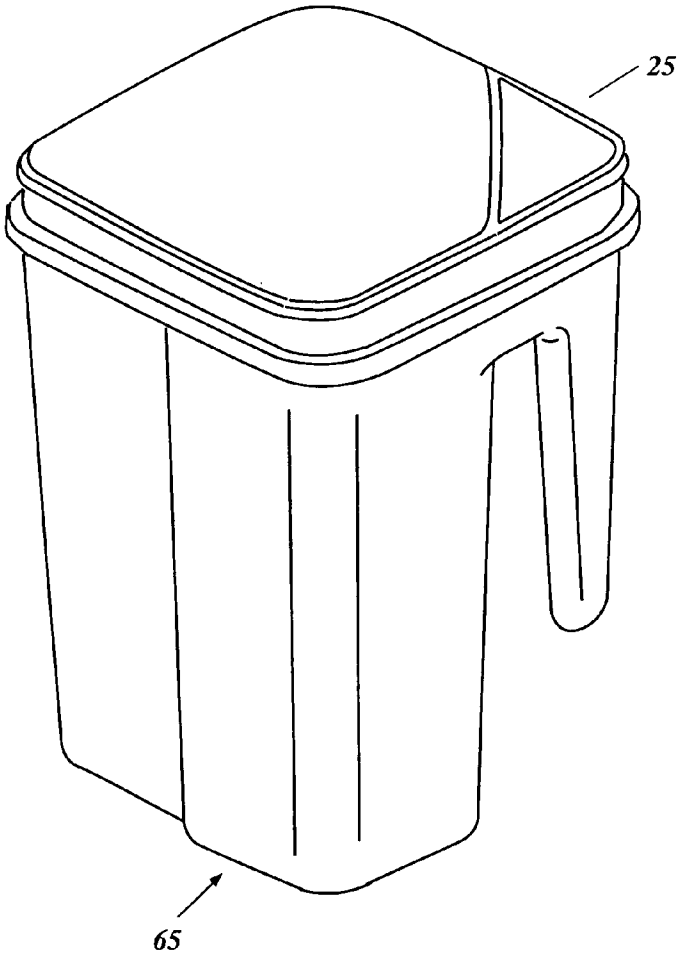
FIG. 9 a perspective view similar to FIG. 6, but shows only the container of FIGS. 6-8, which container is identical to the container of FIG. 4 but for the recessed bottom (shaped to stackingly engage the recessed lid).

Preferably, and as shown in FIGS. 4 and 9 (for each of those exemplary embodiments), the bottom of the corresponding container is shaped to substantially engage the respective raised cover portion 55 and/or recess cover portion 60. Among other things, this allows the bottom of one container 65 to be received by the raised cover portion 55 and/or recessed cover portion 60 of another container during stacking, and improves the stability of such stacks. Persons of ordinary skill in the art will understand that, although only two containers are shown in the stacks of FIGS. 5 and 10, multiple container assemblies 5 may be stacked in certain applications. Those persons will further understand that the lids preferably are also nestable with each other when not assembled on corresponding containers.

As indicated above, persons of ordinary skill in the art also will understand that the container assembly 5, including cover 10 having a raised/recessed cover portion 55/60, built-in pour feature 20, hinged handle cover 25, and tamper evident assembly 30 can be fabricated in any of a wide range of useful sizes as well as a wide variety of shapes, and can be manufactured from a wide variety of materials (including plastic, metal, etc.) and fabrication processes.

Figure 11:
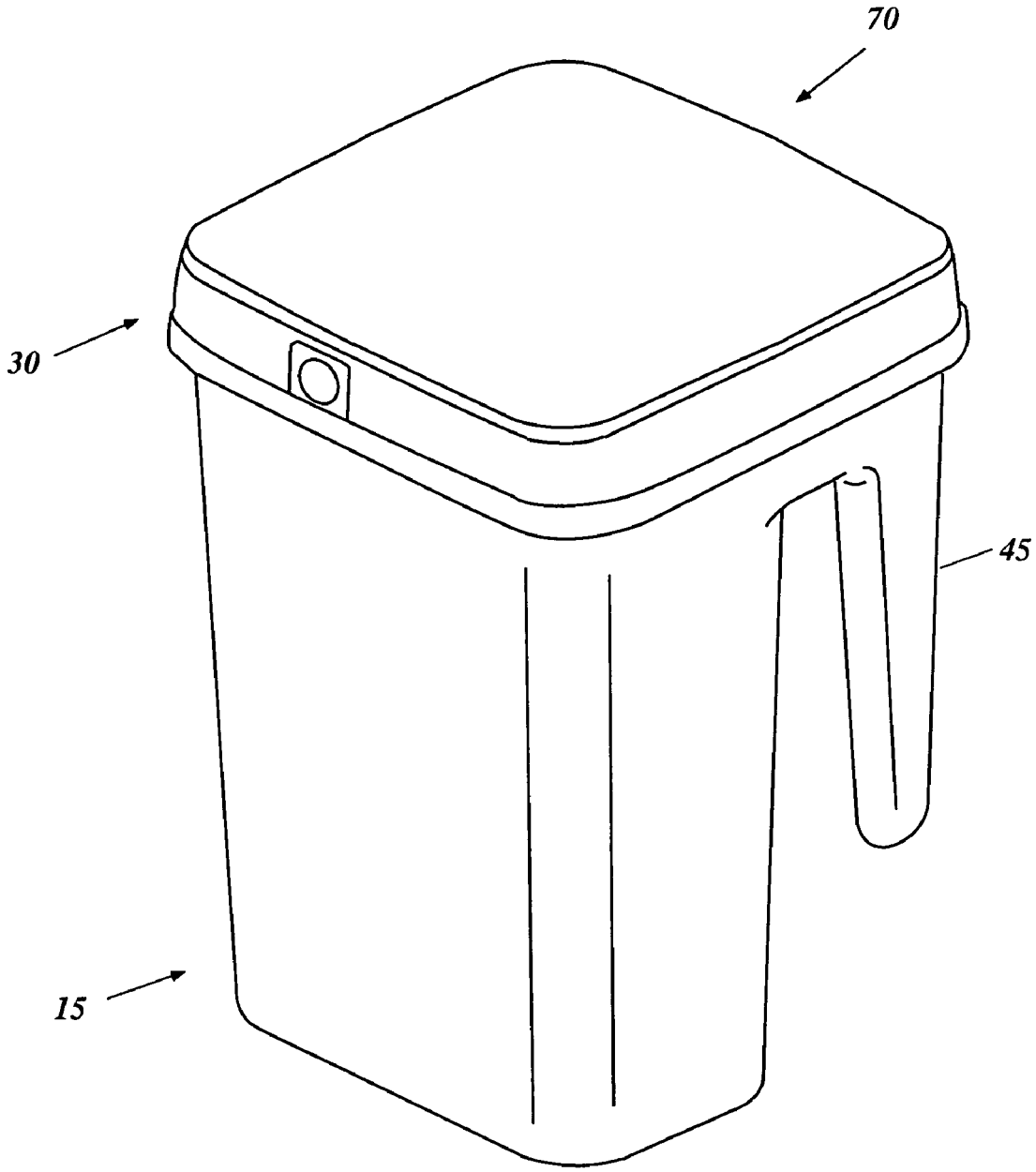
FIG. 11 is a perspective view showing still another of the many alternative embodiments of the invention, including a flat cover with a tamper evident package having a tear strip with ring pull feature.
Figure 12:
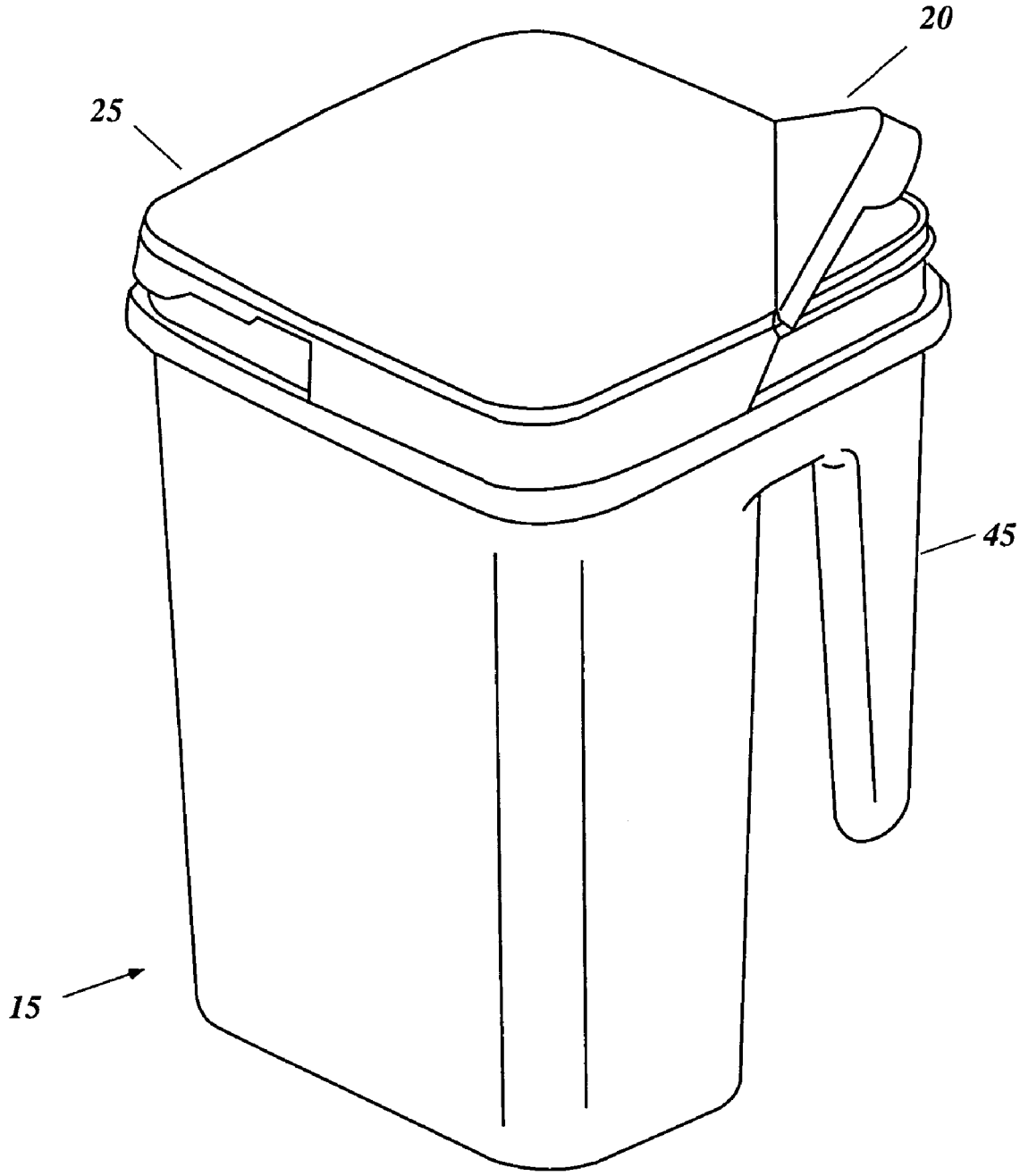
FIG. 12 is a perspective view similar to FIG. 11, but shows the hinged handle cover in an open position, and its tear strip removed.
Figure 13:
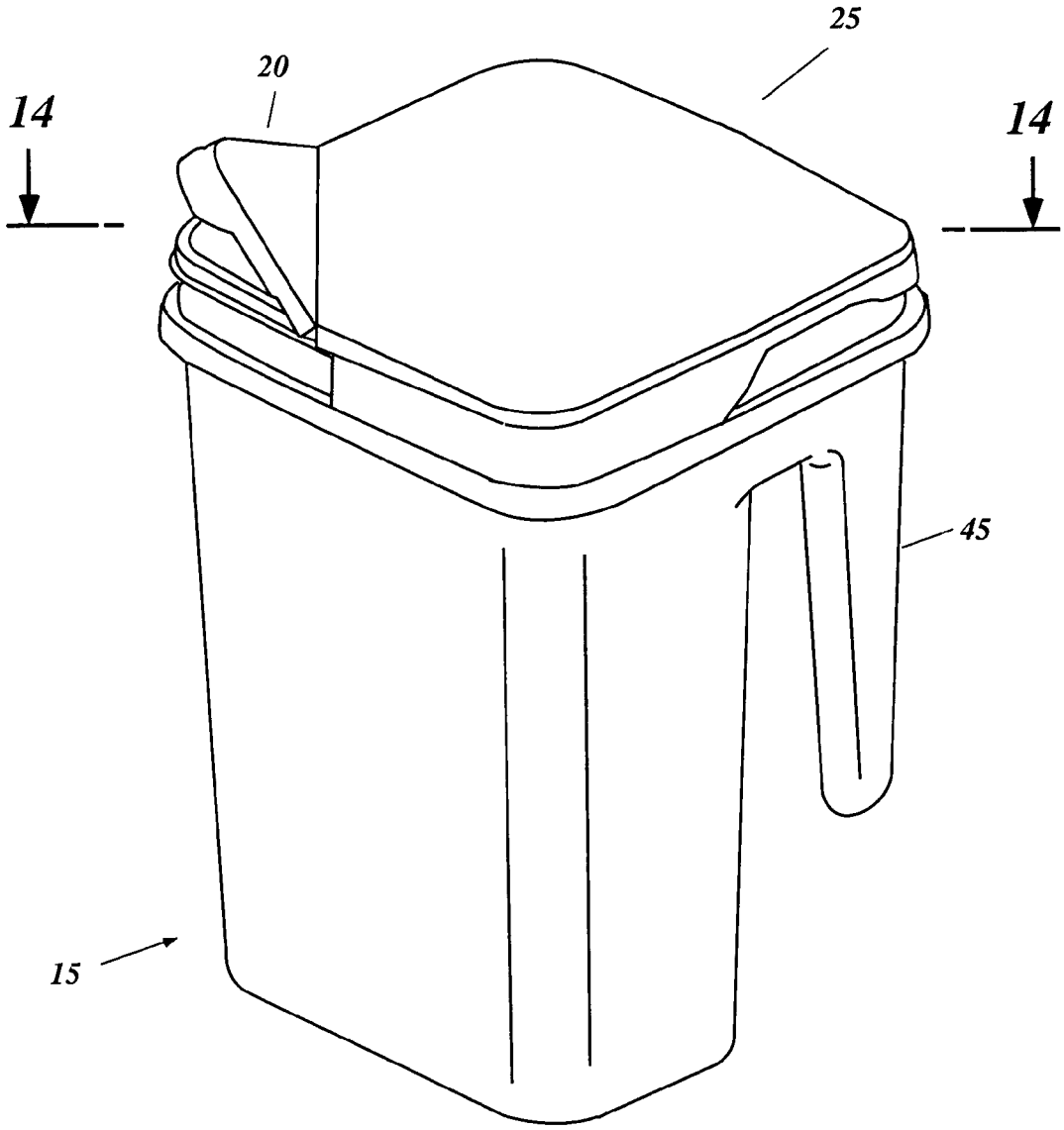
FIG. 13 is a perspective view similar to FIG. 12, but shows the built-in pour feature in an open position.

Yet another embodiment of the present invention, as shown in FIGS. 11-13, includes a flat cover 70 having a built-in pour feature 20, hinged handle cover 25, optional tamper evident assembly 30, while still providing efficient side-by-side packaging of substantially similar container assemblies 5. For embodiments in which the handle compartment is "divided" from the main body of the container, the flat lid of FIGS. 11-13 can simply abut the top of any such "divider" formed or provided in the container. Depending on the materials or things in the container and the stiffness of the lid and container body, that abutment can be sufficient to provide a desired degree of segregation or isolation between the container chambers or compartments.

Thus, the invention provides methods and apparatus that, among other things, combines the stacking and nesting benefits of a raised or recessed cover with a built-in pour feature and a separate hinged cover over an optional storage space such as a handle.

Persons of ordinary skill in the art will understand that a wide variety of other combinations of the elements and improvements herein may be used in certain applications, rather than just those combinations shown in the drawings and expressly described herein. Moreover, although the drawings and description herein are directed to "square" containers and associated lids, persons of ordinary skill in the art will understand that other container shapes (rectangular, diamond, triangular, generally circular, oval, etc.) may utilize and benefit from one or more aspects of the invention.

While certain embodiments are illustrated in the drawings and are described herein, including preferred embodiments, it will be apparent to those skilled in the art that the specific embodiments described herein may be modified without departing from the inventive concepts described.

What is claimed is:

1. A container nestable with like containers, comprising:

a main storage compartment;

a handle storage compartment, where the handle storage compartment is unitary with the main storage compartment, wherein the handle storage compartment is spaced at least a distance from the main storage compartment to facilitate gripping around a perimeter of the handle storage compartment by a user, wherein the depth of the handle storage compartment in a vertical direction is greater than the widest width of the handle storage compartment in a horizontal direction, wherein the depth of the handle storage compartment is less than the depth of the main storage compartment; and an upper rim of the container forming a generally rectangular periphery around the main storage compartment and the handle storage compartment, wherein the generally rectangular periphery includes first, second, third and fourth corner regions, wherein the handle storage compartment is located at the first corner region and the main storage compartment is located at the second, third and fourth corner regions.

2. The container of claim 1, further comprising a land between the handle and the main storage compartment.

3. The container of claim 1, further comprising a divider between the main storage compartment and the handle storage compartment.

4. A container and lid, comprising:

a main storage compartment of the container;

a handle storage compartment of the container, wherein the handle storage compartment is unitary with the main storage compartment and is spaced at least a distance from the main storage compartment to facilitate gripping around a perimeter of the handle storage compartment by a user, wherein the depth of the handle storage compartment in a vertical direction is greater than the widest width of the handle storage compartment in a horizontal direction, wherein the depth of the handle storage compartment is less than the depth of the main storage compartment;

a land of the container between the handle storage compartment and the main storage compartment;

an upper rim of the container around the main storage compartment and the handle storage compartment;

a central section of the lid configured to cover the main storage compartment and the handle storage compartment;

an edge portion of the central section of the lid configured to contact the upper rim of the container; and a downwardly depending flange of the lid around a periphery of the edge portion of the lid;

wherein the container is nestable with like containers, and wherein the lid is nestable with like lids.

5. The container and lid of claim 4, further comprising a seal structure on at least one of an underside of the central section of the lid and the land of the container, wherein the seal structure is configured to seal the main storage compartment and the handle storage compartment from each other.

6. The container and lid of claim 4, further comprising a ridge on the central section of the lid configured to protect against horizontal shifting between a lid and a container stacked thereon.

7. The container and lid of claim 4, further comprising a ridge on the edge portion of the lid configured to protect against horizontal shifting between a lid and a container stacked thereon.

8. The container and lid of claim 4, wherein the upper rim forms a generally rectangular shape around the main storage compartment and the handle storage compartment.

9. The container and lid of claim 4, further comprising a container detent on an exterior of the container.

10. The container and lid of claim 9, further comprising a lid detent on an interior of the downwardly depending flange configured to contact the container detent.

11. The container and lid of claim 4, further wherein the central section of the lid includes a hinge configured to permit a portion of the central section to be pivoted away from the container.

12. The container and lid of claim 11, further comprising a tamper-evidencing tear strip portion of the downwardly depending flange, the tear strip being configured so that removal of the tear strip from the lid releases the pivotable portion of the central section.

13. The container and lid of claim 4, further comprising an outwardly extending flange on the exterior of the container configured to be adjacent to a lower edge of the downwardly depending flange of the lid.

14. A container and lid, comprising:

a container that is nestable with like containers, comprising:

a main storage compartment;

a handle storage compartment configured to facilitate pouring of main storage compartment contents from the main storage compartment, wherein the handle storage compartment is unitary with the main storage compartment and spaced at least a distance from the main storage compartment to facilitate gripping around a perimeter of the handle storage compartment by a user, wherein the depth of the handle storage compartment in a vertical direction is greater than the widest width of the handle storage compartment in a horizontal direction;

an upper rim forming a substantially rectangular periphery around the main storage compartment and the handle storage compartment, wherein the substantially rectangular periphery includes first, second, third and fourth corner regions, wherein the handle storage compartment is located at the first corner region and the main storage compartment is located at the second, third and fourth corner regions; and a land between the main storage compartment and the handle storage compartment; and a lid that is nestable with like lids, comprising:

a central section configured to cover the main storage compartment and the handle storage compartment;

an edge portion configured to contact the upper rim of the container, including the first, second, third and fourth corner regions; and a hinge configured to permit the portion of the central section covering the second corner region to pivot away from the container while the portions of the central section covering the first, third and fourth corner regions remain, thereby the contents of the main storage compartment are allowed to be poured through the pivoted portion of the lid at the second corner region while the handle storage compartment at the first corner region is gripped by the user.

15. The container and lid of claim 14, wherein the container further comprises a downwardly extending flange around a periphery of the edge portion and a container detent on an exterior surface of the main storage compartment.

16. The container and lid of claim 15, wherein the lid further comprises a lid detent on an interior surface of the downwardly extending flange configured to contact the container detent.

17. The container and lid of claim 15, wherein the container further comprises an outwardly extending flange contacting the exterior surface of the main storage compartment, wherein the outwardly extending flange is below the container detent.

18. The container and lid of claim 17, wherein the container further comprises a downwardly extending flange on a lower surface of the outwardly extending flange.

19. The container and lid of claim 17, wherein the lid further comprises a downwardly extending flange around a periphery of the edge portion, wherein a lowermost edge of the downwardly depending flange is configured to lie adjacent the outwardly extending flange of the container.

20. The container and lid of claim 19, wherein the lid further comprises a tear line on the downwardly extending flange defining between a lower tearstrip portion of the downwardly extending flange and an upper portion of the downwardly extending flange, wherein a lower edge of the upper portion of the downwardly extending flange at the second corner region is lower than a lower edge of the upper portion at a portion adjacent the second corner region.

21. The container and lid of claim 19, wherein the lid further comprises a second downwardly extending flange configured to lie adjacent an interior surface of the upper rim of the container.

22. The container and lid of claim 14, wherein the container further comprises an upwardly extending wall on an upper surface of the land, wherein the upwardly extending wall has a first surface facing the main storage compartment and a second surface facing the handle storage compartment.

23. The container and lid of claim 22, wherein the lid further comprises a seal structure on a lower surface of the central section configured to engage with the first and second surfaces of the upwardly extending wall.

24. The container and lid of claim 14, wherein the upper rim forms a substantially square periphery around the main storage compartment and the handle storage compartment.

25. The container and lid of claim 14, wherein the first corner region is opposite the second corner region.

* * * * *